US007461442B2

(12) United States Patent
Johnson et al.

(10) Patent No.: US 7,461,442 B2
(45) Date of Patent: Dec. 9, 2008

(54) ASSEMBLY APPARATUS AND PROCESS FOR A CHAIR BACK

(75) Inventors: Eric Johnson, Hudsonville, MI (US); Steve Gager, Holland, MI (US); Wesley D. Mersman, Holland, MI (US); Larry A. Wilkerson, Comstock Park, MI (US)

(73) Assignee: Haworth, Inc., Holland, MI (US)

( * ) Notice: Subject to any disclaimer, the term of this patent is extended or adjusted under 35 U.S.C. 154(b) by 137 days.

(21) Appl. No.: 11/449,555

(22) Filed: Jun. 8, 2006

(65) Prior Publication Data

US 2007/0000111 A1 Jan. 4, 2007

Related U.S. Application Data

(60) Provisional application No. 60/689,761, filed on Jun. 10, 2005.

(51) Int. Cl.
*B68G 7/00* (2006.01)
*A47C 7/02* (2006.01)
*B23P 19/00* (2006.01)

(52) U.S. Cl. ..... 29/91.1; 29/91.5; 29/448; 29/450; 29/243.5; 29/281.1; 297/451.1; 297/452.1; 297/452.13

(58) Field of Classification Search ..... 29/91.1, 29/91.5, 448, 450, 700, 787, 789, 235, 243.5, 29/281.1, 284; 297/440.11, 445.1, 452.1, 297/452.13, 452.18
See application file for complete search history.

(56) References Cited

U.S. PATENT DOCUMENTS

| | | | |
|---|---|---|---|
| 1,864,477 | A | 6/1932 | Stannard |
| 3,197,789 | A | 8/1965 | Ashkouti et al. |
| 3,214,314 | A | 10/1965 | Rowbottam |
| 3,601,446 | A | 8/1971 | Horby et al. |
| 3,640,576 | A | 2/1972 | Morrison et al. |
| 3,804,462 | A | 4/1974 | Kobayashi |
| 3,895,141 | A | 7/1975 | Steele et al. |
| 4,299,645 | A | 11/1981 | Newsom |
| D274,768 | S | 7/1984 | Ohl |
| 4,552,406 | A | 11/1985 | Ohl |
| 4,743,323 | A | 5/1988 | Hettinga |
| 5,178,815 | A | 1/1993 | Yokote et al. |
| 5,318,348 | A | 6/1994 | Hess |
| 5,662,383 | A | 9/1997 | Hand |
| 5,768,761 | A | 6/1998 | Zeiler et al. |
| 6,065,197 | A | 5/2000 | Iseki et al. |

(Continued)

FOREIGN PATENT DOCUMENTS

EP 1 226 744 A1 7/2002

*Primary Examiner*—Jermie E Cozart
(74) *Attorney, Agent, or Firm*—Flynn, Thiel, Boutell & Tanis, P.C.

(57) ABSTRACT

An office chair is provided having a contoured back assembly comprising a back frame and a suspension fabric. The fabric is attached to the back frame through a spline wherein the back frame has a three-dimensional contoured shape formed by overlapped frame rings with the fabric being joined thereto by a spline. The fabric is secured to the frame by a machine wherein the fabric is first stretched from the outer edge of the fabric and then is clamped to a frame surface in the pre-tensioned or pre-streched condition. The fabric edges are allowed to hang loose and then fixed in the frame by a spline. Once secured, the fabric is unclamped from the frame.

24 Claims, 31 Drawing Sheets

U.S. PATENT DOCUMENTS 6,125,521 A 10/2000 Stumpf et al.
6,254,190 B1 7/2001 Gregory
6,292,990 B1 9/2001 Iseki et al.
6,315,364 B1 11/2001 Fujita et al.
6,328,548 B1 12/2001 Salas et al.
6,378,944 B1 4/2002 Weisser
6,444,152 B1 9/2002 Salas et al.
6,540,950 B1 4/2003 Coffield
6,550,866 B1 4/2003 Su
6,702,390 B2 3/2004 Stumpf et al.
6,758,528 B2 * 7/2004 Kawashima ..... 297/452.56
2002/0106479 A1 8/2002 Coffield et al.
2002/0195863 A1 12/2002 Su
2003/0071509 A1 4/2003 Neil et al.
2003/0160494 A1 8/2003 Coffield
2004/0104615 A1 6/2004 Coffield et al.
2005/0044678 A1 * 3/2005 Cvek ..... 29/91.5
2005/0248205 A1 * 11/2005 Neil et al. ..... 297/452.18
2005/0273991 A1 * 12/2005 Nagele ..... 29/91.7

* cited by examiner

ASSEMBLY APPARATUS AND PROCESS FOR A CHAIR BACK

CROSS REFERENCE TO RELATED APPLICATIONS

This application claims the benefit of U.S. Provisional Application Ser. No. 60/689 761, filed Jun. 10, 2005, which is incorporated herein by reference in its entirety.

FIELD OF THE INVENTION

The invention relates to an office chair with an improved chair back and more particularly, to a chair back with a peripheral frame and a suspension fabric which is secured to the frame by an improved attachment apparatus and method.

BACKGROUND OF THE INVENTION

Preferably, conventional office chairs are designed to provide significant levels of comfort and adjustability. Such chairs typically include a base which supports a tilt control assembly to which a seat assembly and back assembly are movably interconnected. The tilt control mechanism includes a back upright which extends rearwardly and upwardly and supports the back assembly rearwardly adjacent to the seat assembly. The tilt control mechanism serves to interconnect the seat and back assembly so that they may tilt rearwardly together in response to movements by the chair occupant and possibly to permit limited forward tilting of the seat and back. Further, such chairs typically permit the back to also move relative to the seat during such rearward tilting.

The back assembly of such office chairs may have a variety of constructions wherein one type of construction includes an annular back frame which defines an open interior in which the chair occupant's back is supported. This central open area is enclosed by a suspension fabric which spans the opening and has the outer peripheral edge thereof affixed to the annular frame.

The back frame further has a section thereof rigidly connected to an upright of the chair. The upright is connected to a tilt control mechanism, which mechanism supports the seat assembly and governs rearward tilting of the upright. As such, the back assembly moves in combination with the upright when the occupant reclines within the chair.

It is an object of the invention to provide an office chair having a chair back arrangement which is improved relative to prior chair back constructions and specifically is improved relative to the attachment of a suspension fabric to the rigid back frame.

Therefore, the invention relates to an office chair and more particularly, to the construction of a chair back assembly and the process for stretching and attaching the suspension fabric to the back frame in a stretched condition.

The back assembly comprises an annular frame having a suspension fabric which spans the central opening of the back and has the periphery of the suspension fabric connected to the frame. The suspension fabric comprises a single layer of suspension material which connects to the frame by a plastic spline that is press fitted into an annular spline channel formed about the periphery of the back frame.

The back frame is defined by side frame rails, which extend vertically, and transverse cross rails, which extend horizontally between the side rails at the top and bottom thereof. The back frame has a contoured shape wherein the side frame rails curve rearwardly and outwardly in the side-to-side direction, while the cross rails also curve in the front-to-back direction to provide a contoured shape for the back frame that comfortably conforms to the chair back of the chair occupant.

To form the spline channel, the back frame is constructed of molded front and back ring sections which are grooved about their respective peripheries to define front and rear channel portions. The front channel portion defines the front wall of the spline channel while the rear channel portion defines the rear channel wall. The front and rear ring sections overlie each other in opposing relation and are rigidly secured together by suitable fastening means such as ultrasonic welding, adhesives or even threaded fasteners. When the two frame sections are rigidly joined together, the grooved portions align with each other and define the spline channel. In this manner, complex contours may be formed in a molded back frame while still permitting the formation of a spline channel about the periphery thereof.

Once the frame is assembled, the suspension fabric is fastened to the frame by a spline which is press fitted into the spline channel and traps the edge portions of the suspension fabric within this channel.

The attachment structure thereby permits the securement of the suspension fabric to the frame using an elastomeric spline. This fabric is pre-stretched during assembly and then secured to the frame in this pre-stretched condition by the spline.

The process involves securing or assembling the two frame sections together to define a frame unit, and then attaching the fabric thereto. Attachment is accomplished by positioning the frame in the bottom nest of an attachment machine, laying a fabric blank over the frame and stretching the fabric in place by a plurality of stretcher clamps placed about the peripheral edge of the fabric. These peripheral stretcher clamps pull or tension the fabric longitudinally to pretension the fabric.

The fabric is then clamped on the upper surface of the frame by a top nest or clamp head which drops over the bottom nest and has a downward facing clamp surface that clamps the fabric surface onto the opposing frame face. This clamping holds the fabric in a stretched condition. Once clamped by the top nest, the peripheral stretcher clamps are released so that the peripheral edge of the fabric blank hangs loose. Thereafter, a spline tool is run around the spline groove of the frame to simultaneously drive a spline and the fabric edge into the groove about the frame periphery which removes the slack in the peripheral fabric edge and secures the fabric to the frame. When the top nest is removed, the fabric remains in the stretched condition due to the securement by the spline. This provides an improved method for securing a fabric to a contoured chair frame.

The foregoing features provide an improved back frame arrangement, wherein other objects and purposes of the invention, and variations thereof, will be apparent upon reading the following specification and inspecting the accompanying drawings.

Figure 2:
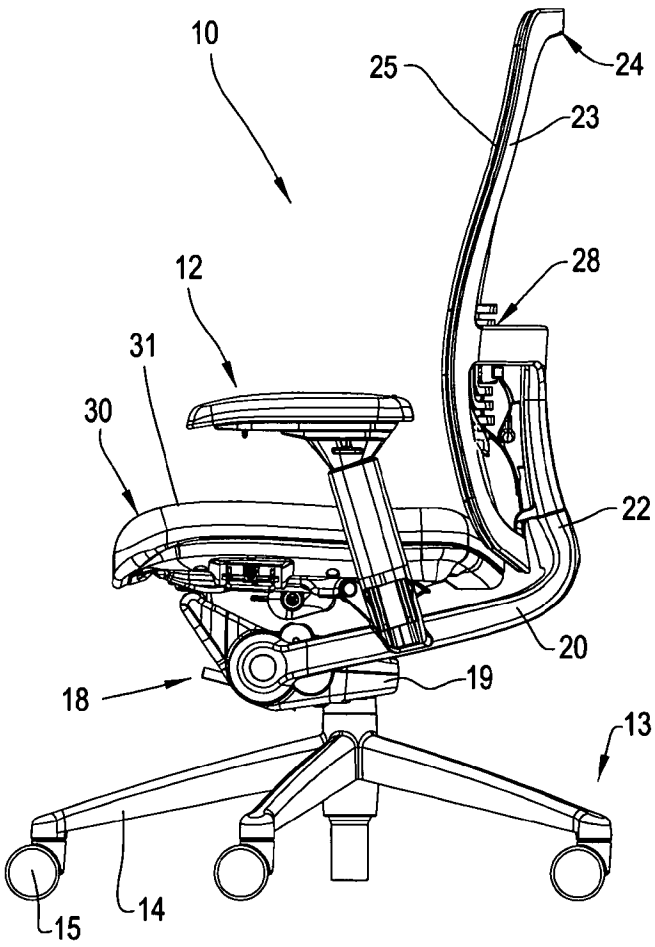
FIG. 2 is a side elevational view of the office chair.
Figure 1:
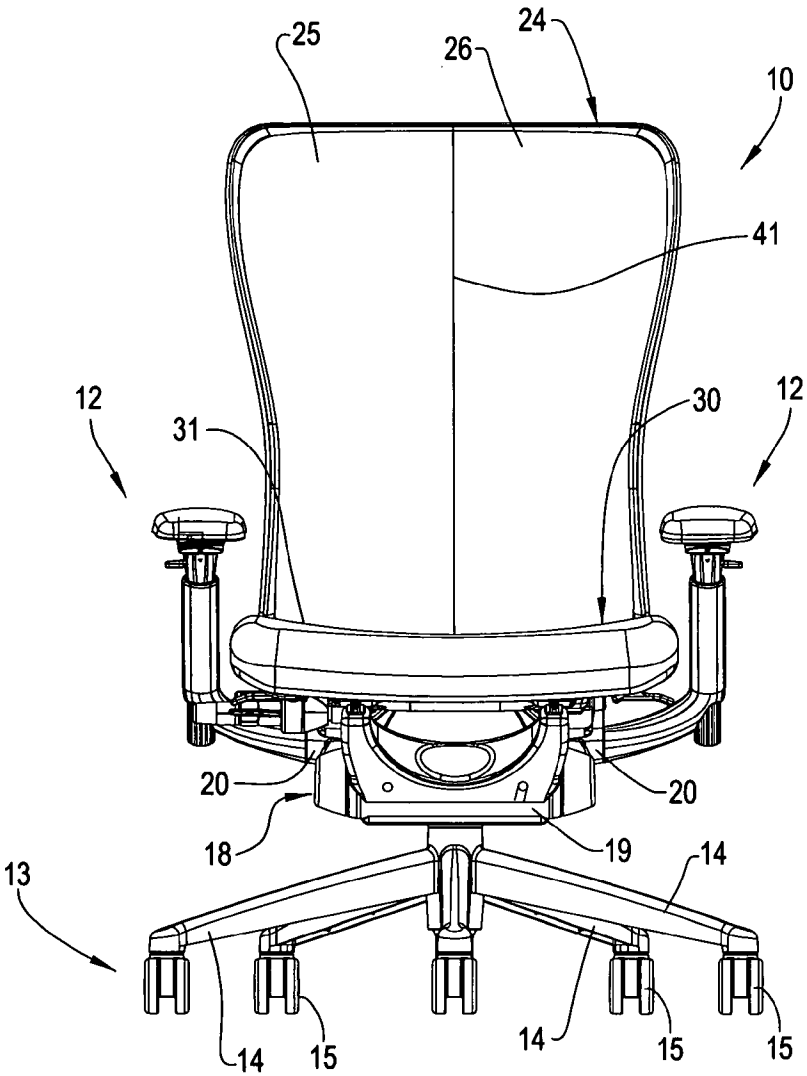
FIG. 1 is a front elevational view of an office chair having an inventive back assembly arrangement.
Figure 4:
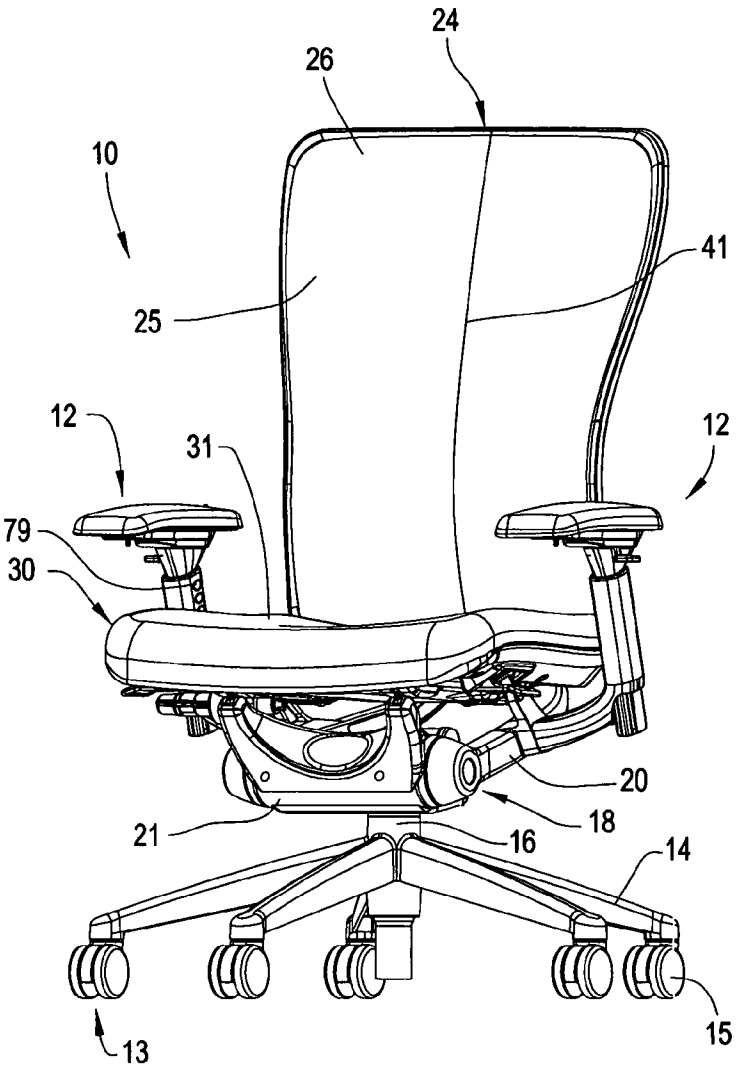
FIG. 4 is a front isometric view thereof.
Figure 3:
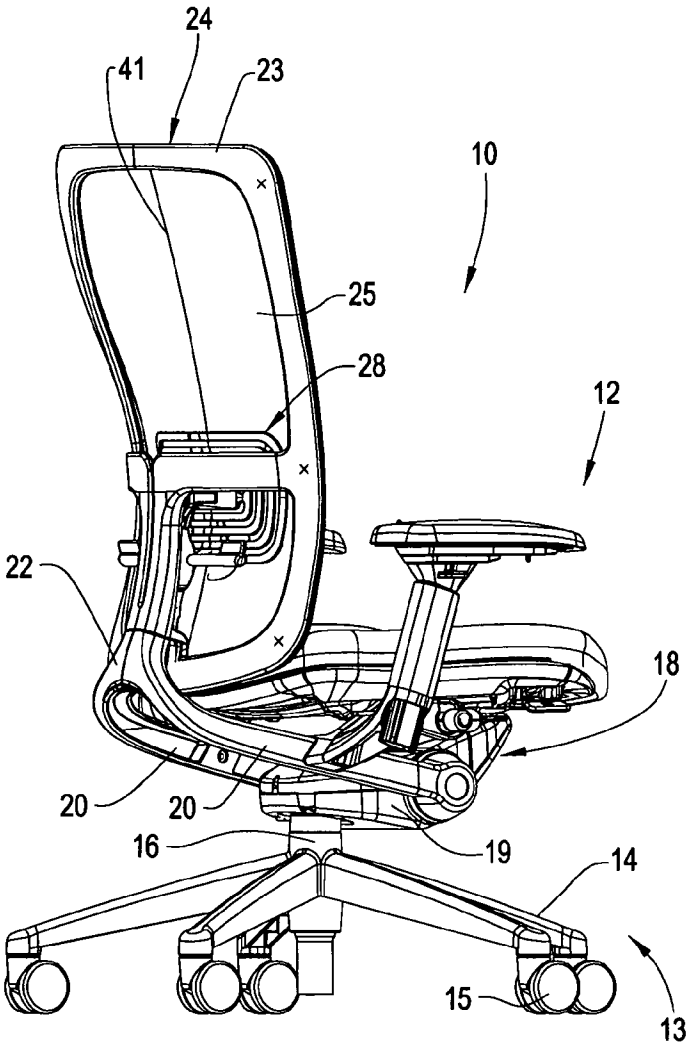
FIG. 3 is a rear isometric view thereof.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIGS. 1-4, the invention generally relates to an office chair 10 which includes various inventive features therein that accommodate the different physical characteristics and comfort preferences of a chair occupant and also improve the assembly of the chair 10.

Generally, this chair 10 includes improved height-adjustable arm assemblies 12 which are readily adjustable. The structure of each arm assembly 12 is disclosed in U.S. Patent Application Ser. No. 60/657,632, entitled ARM ASSEMBLY FOR A CHAIR, which is owned by Haworth, Inc., the common assignee of this present invention. The disclosure of this patent application is incorporated herein in its entirety by reference.

The chair 10 is supported on a base 13 having radiating legs 14 which are supported on the floor by casters 15. The base 12 further includes an upright pedestal 16 which projects vertically and supports a tilt control mechanism 18 on the upper end thereof. The pedestal 16 has a pneumatic cylinder therein which permits adjustment of the height or elevation of the tilt control mechanism 18 relative to a floor.

The tilt control mechanism 18 includes a control body 19 on which a pair of generally L-shaped uprights 20 are pivotally supported by their front ends. The uprights 19 converge rearwardly together to define a connector hub 22 on which is supported the back frame 23 of a back assembly 24 the structure of which is disclosed in U.S. Patent Application No. 60/657,313 entitled CHAIR BACK which is owned by Haworth, Inc. The disclosure of this patent application is incorporated herein in its entirety by reference. The structure of this tilt control mechanism is disclosed in U.S. Patent Application Ser. No. 60/657,541, entitled TILT CONTROL MECHANISM FOR A CHAIR, and U.S. Patent Application Ser. No. 60/657,524, entitled TENSION ADJUSTMENT MECHANISM FOR A CHAIR, which applications are owned by Haworth, Inc. The disclosure of each of these patent applications is incorporated herein in its entirety by reference.

The back assembly has a suspension fabric 25 supported about its periphery on the corresponding periphery of the frame 23 to define a suspension surface 26 against which the back of a chair occupant is supported.

To provide additional support to the occupant, the back assembly 24 also includes a lumbar support assembly 28 which is configured to support the lumbar region of the occupant's back and is adjustable to improve the comfort of this support. The structure of this lumbar support assembly 28 and pelvic support structure is disclosed in U.S. Patent Application Ser. No. 60/657,312, entitled CHAIR BACK WITH LUMBAR AND PELVIC SUPPORTS, which is also owned by Haworth, Inc. The disclosure of this patent application is incorporated herein in its entirety by reference.

Additionally, the chair 10 includes a seat assembly 30 that defines an upward facing support surface 31 on which the seat of the occupant is supported.

Figure 6:
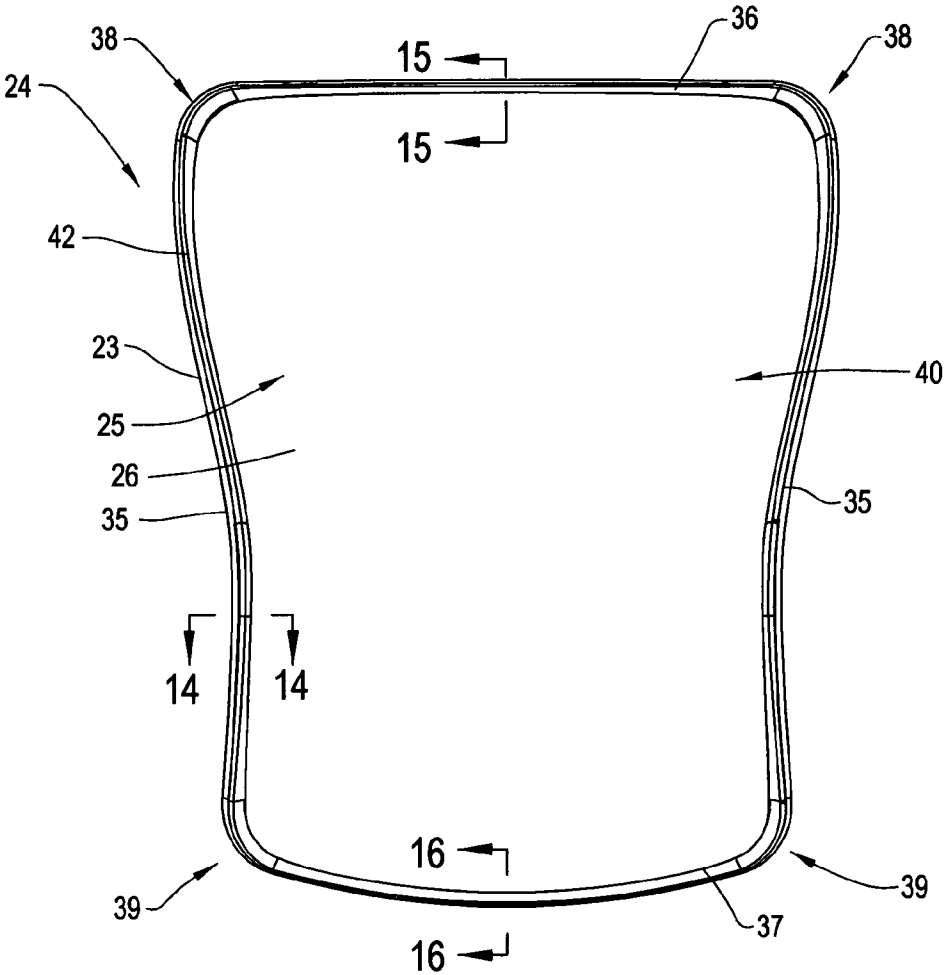
FIG. 6 is a front view thereof.
Figure 5:
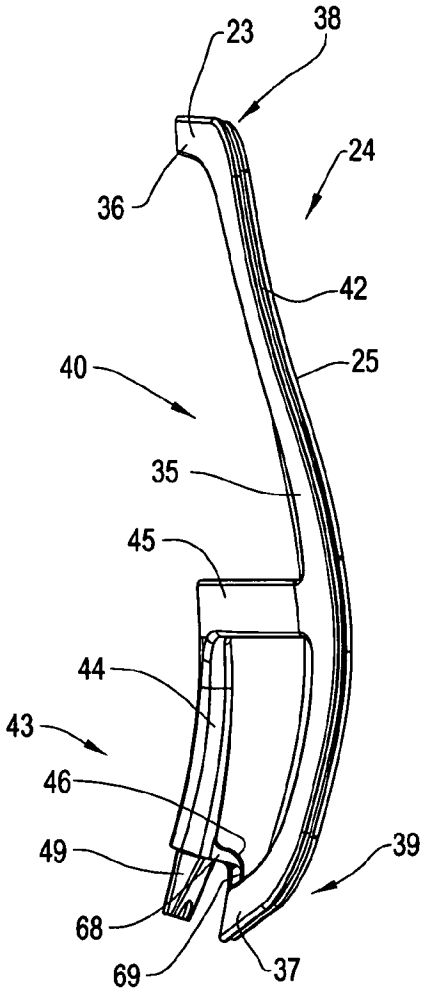
FIG. 5 is a side view of a back assembly.
Figure 7:
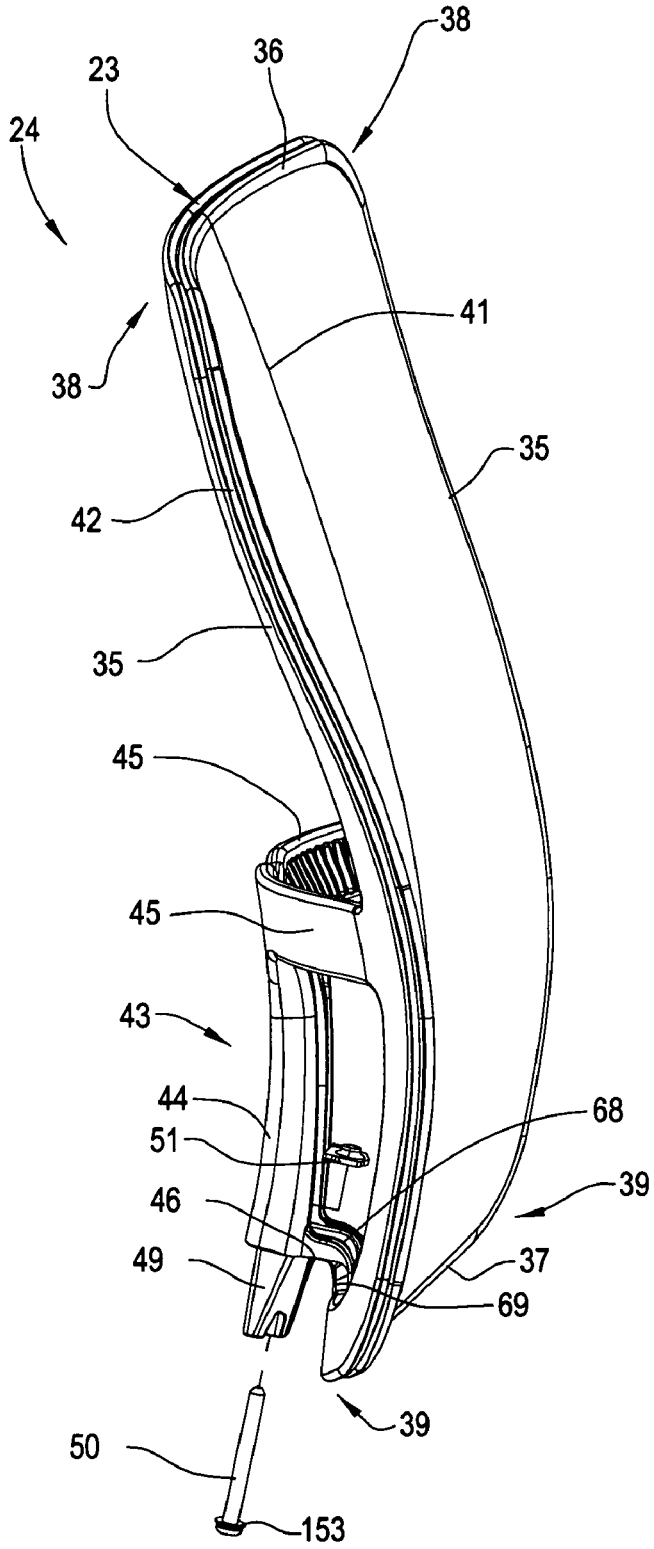
FIG. 7 is an exploded isometric view of the back assembly with a fastener for mounting the back frame on the tilt control mechanism of the chair.
Figure 8:
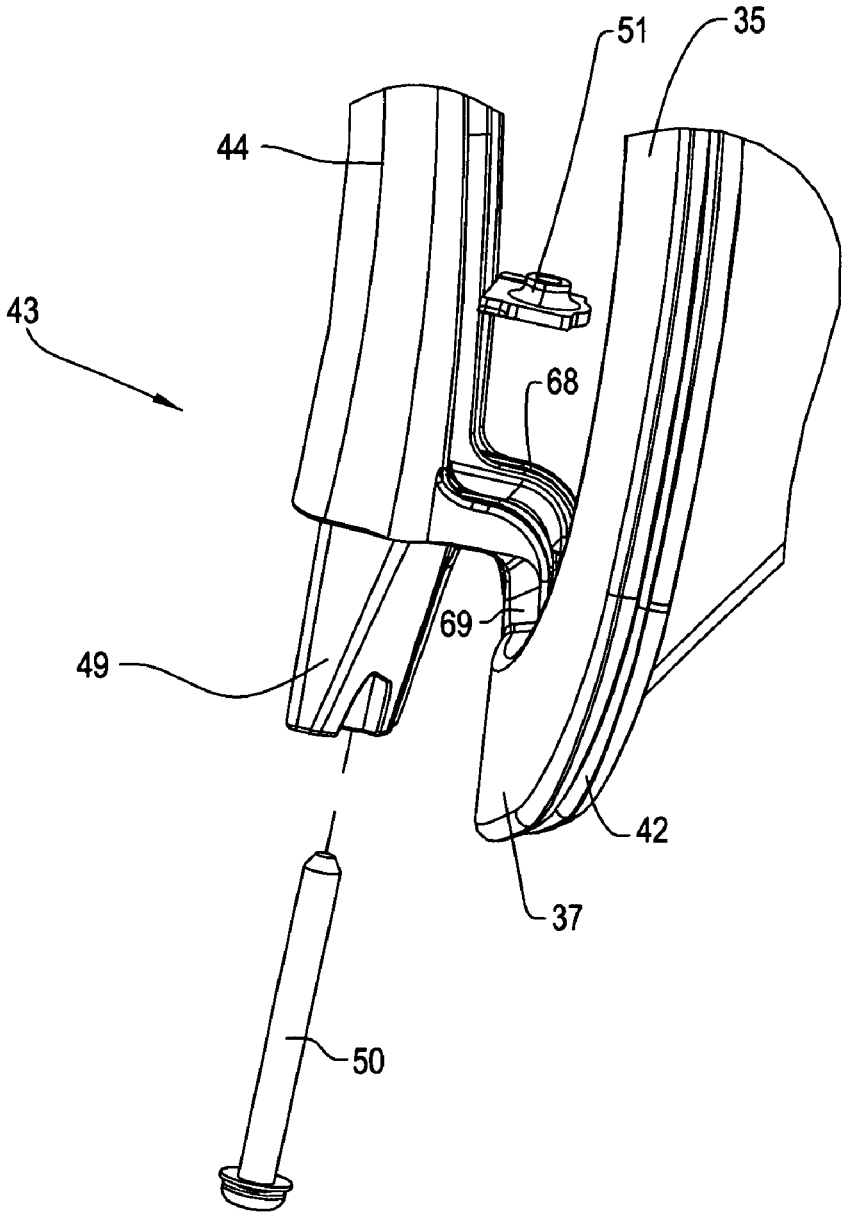
FIG. 8 is an enlarged exploded view of the mounting section of the back frame.

More particularly as to the back assembly 24, the back assembly 24 is generally illustrated in FIGS. 5-7. The back frame 23 comprises a pair of vertical side frame rails 35, a top frame rail 36, and a bottom frame rail 37 which are joined together at the upper corners 38 of the back assembly 24 as well as the lower corners 39 to define an annular or endless frame having a central opening 40.

As can be seen in FIGS. 5-7, the back frame 23 has a contoured shape which ergonomically supports the back of the user. In particular, the side rails 35 curve backwardly as seen in FIGS. 5 and 7 as well as outwardly (FIG. 6) relative to the bottom portions of the side rails 35. Further, the top rail 36 and bottom rail 37 each have a respective curvature to closely conform to the curvature of a typical chair occupant.

To support the occupant, the back assembly 24 includes the suspension fabric 25 which is secured taughtly on the frame. Specifically, the back frame 23 includes a peripheral spline channel 42, in which is fixed the peripheral edge 25A of the suspension fabric 25 as will be discussed in further detail herein.

The back frame 23 also generally includes a support structure 43 to which the side rails 35 and bottom rail 37 are rigidly interconnected. This support structure 43 comprises an upright support column 44 which extends along the chair centerline 41 (FIG. 7) to an elevation located just below the middle of the side rails 35. The upper end of the support column 44 includes a pair of support arms 45 which extend sidewardly and have each respective outer end connected rigidly to one of the side rails 35.

The lower end of the support column 43 includes a generally L-shaped connector flange 46 (FIGS. 5 and 7) which projects forwardly and then downwardly into fixed engagement with the lower cross rail 37. Still further, this lower column end includes a bayonet connector 49 which projects downwardly for rigid connection to the uprights 20 by fastener bolt 50 and nut 51 as will be described in further detail hereinafter.

Figure 9:
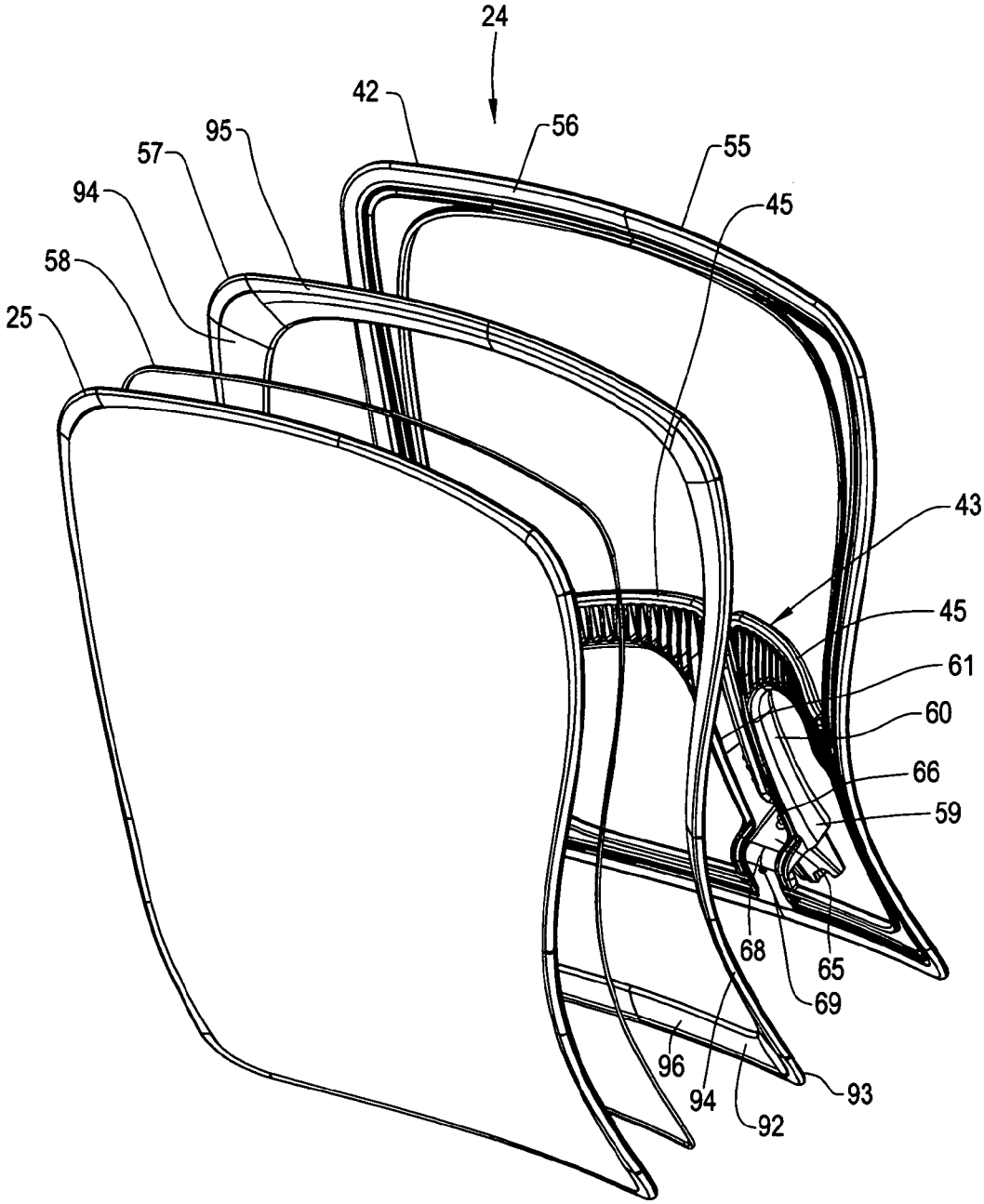
FIG. 9 is an exploded isometric view of the back components forming the back assembly.

Referring more particularly to the components of the back assembly 24, FIG. 9 illustrates these components in an exploded view thereof. In particular, the frame 23 comprises a molded rear frame unit 55 that includes the support structure 43 described above as well as a rear frame ring 56 which is supported on the support arms 45 of the support structure 44. The back frame 23 further includes a molded front frame ring 57 which is adapted to be mounted to the rear frame ring 56 in overlying relation to define the spline channel 42 about the periphery thereof. Further, the back assembly 24 includes the above-described suspension fabric 25 and an elastomeric spline 58.

Figure 11:
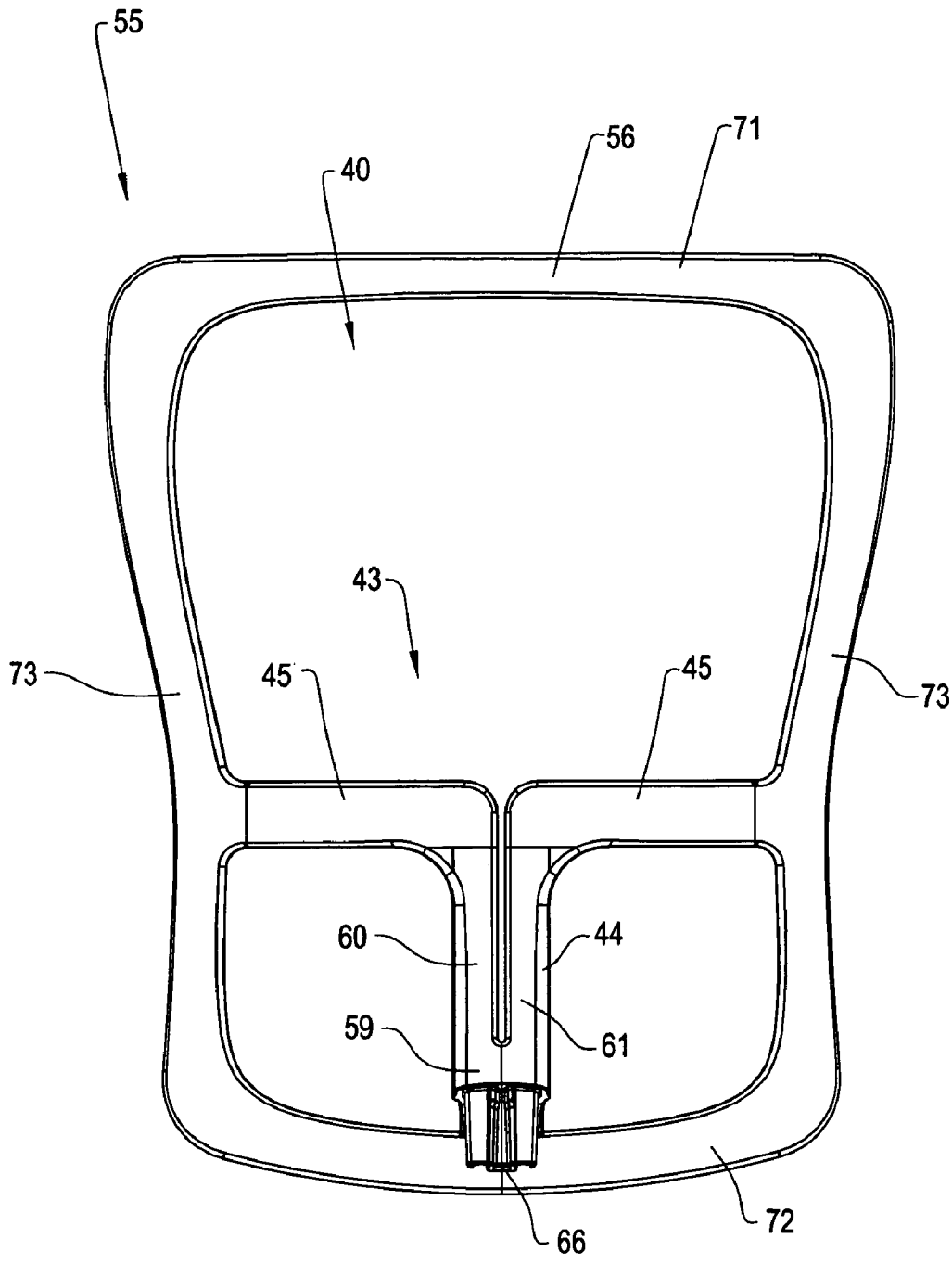
FIG. 11 is a rear view of the back frame.
Figure 12:
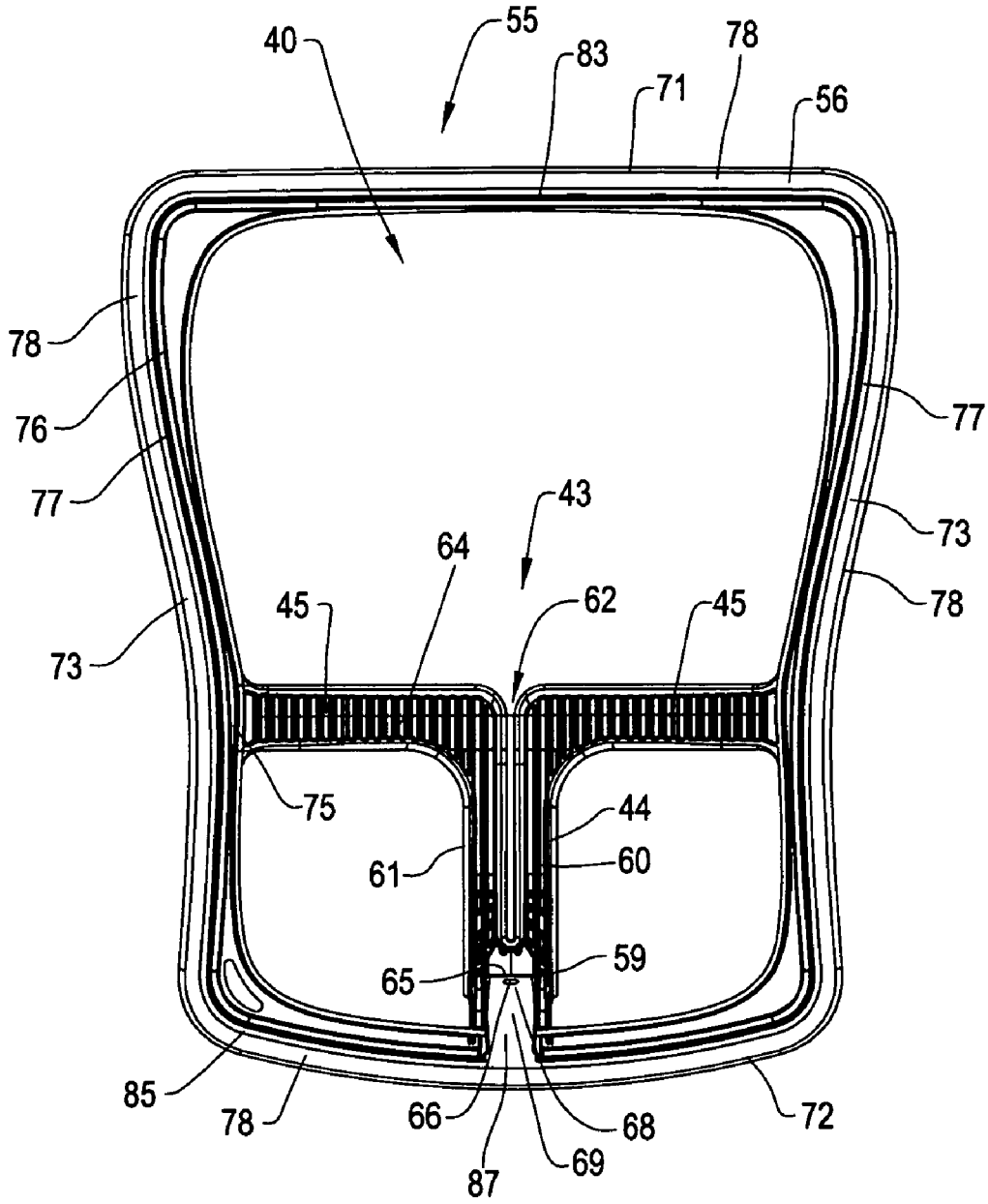
FIG. 12 is a front view of the back frame.

Referring to FIGS. 11 and 12, the rear frame unit 55 comprises the support structure 43 and the rear frame ring 56. Both the support structure 43 and the rear frame ring 56 are molded simultaneously together in a one-piece monolithic construction having the contoured shape described above. To facilitate molding of this contoured shape while still possessing the spline channel 42 mentioned above, the rear frame ring 56 and front frame ring 57 are molded separate from each other and then affixed together.

Turning to the support structure 43, the support column 44 thereof is located centrally within the lower half of the central frame opening 40. The support column 44 has a base end 59 and a pair of column halves 60 and 61 which are separated from each other by a vertically elongate column slot 62. The column 44 therefore is formed as a split column by the slot 62 which extends along a substantial portion of the length of the column 44 with the column halves 60 and 61 being joined together by the solid base section 59. As such, the column halves 60 and 61 are supported in cantilevered relation by the base section 59. The rear frame unit 55 and front frame ring 57 are formed from a glass filled nylon material that is molded into the desired shapes wherein this material has limited flexure so as to permit flexing of the various areas of the frame when placed under load by a chair occupant. Since the column halves 60 and 61 are separated from each other by the slot 62, these column halves 60 and 61 may articulate independently of each other to facilitate flexing movement of the various frame corners 38 and 39.

The upper ends of the frame halves 60 and 61 join integrally to the transverse arms 45. The outer ends of the arms 45 extend outwardly and are molded integral with the vertical sides of the rear frame ring 56. As seen in FIG. 12, the inside faces of the column halves 60 and 61 and the support arms 45 have an appropriate pattern of ribbing 64 to selectively rigidify the support structure 43 while still permitting flexure thereof.

Figure 10:
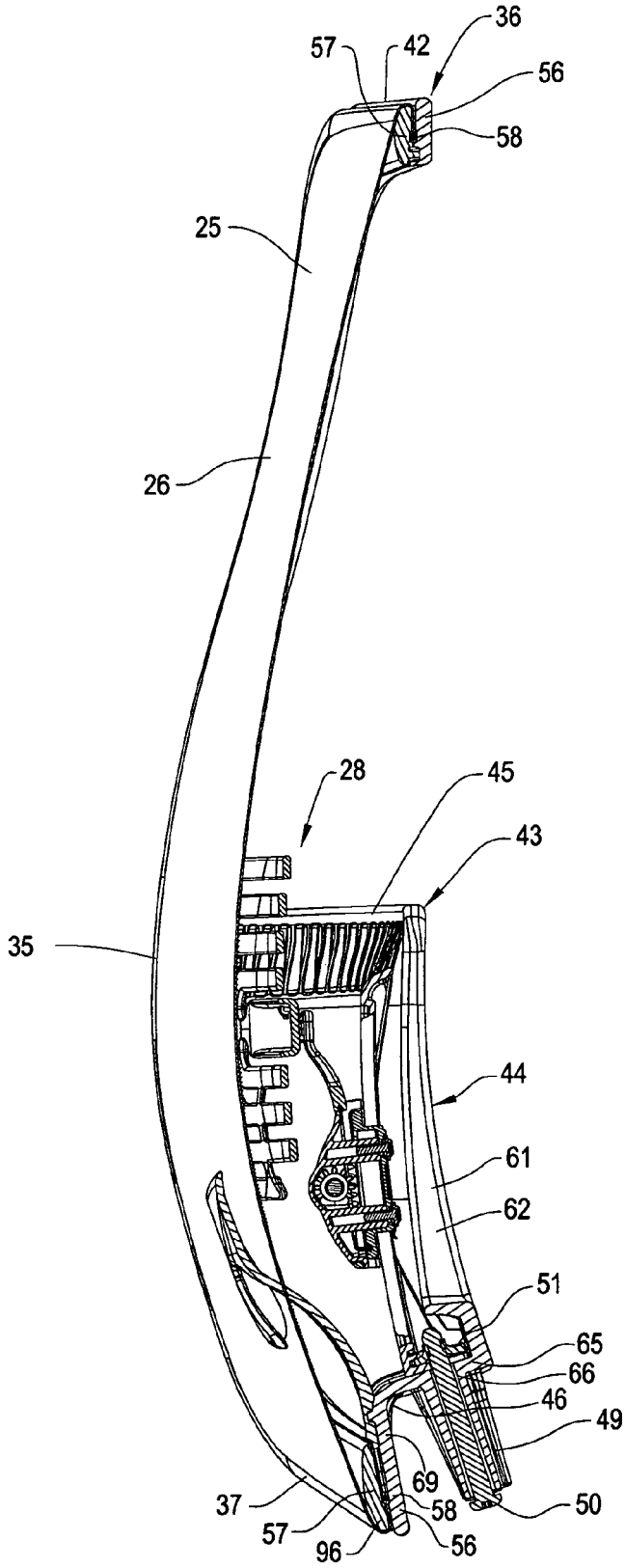
FIG. 10 is a side cross-sectional view of the back assembly as taken along the centerline of the back assembly.

In the column base 59, this column base 59 terminates at a bottom wall 65 (FIGS. 9, 10 and 12), which is formed with a bore 66 extending vertically therethrough. The bottom wall 65 further is formed integral with the bayonet connector 49 wherein the bore 66 extends vertically through this bottom wall 65 and the bayonet 49 as seen in FIG. 10. When joining the back frame 23 to the chair uprights 20, the fastener 50 extends upwardly from the uprights 20 as will be described in further detail herein and extends through the fastener bore 66 so that it projects vertically above the bottom column wall 65. The upper end of the fastener 50 is engaged by the threaded nut 51 as seen in FIG. 10 to thereby secure the back frame 23 to the uprights 20. This interconnection between these components will be described in further detail hereinafter.

Further as to the bottom wall 65, this wall extends forwardly to define a horizontal leg 68 of the L-shaped flange 46, which flange 46 then turns downwardly to define a vertical leg 69 (FIGS. 5, 7 and 10). The bottom column section 59 serves to rigidly support the bottom cross rail 37 of the back frame 23. As such, the bottom frame rail 37 is more rigidly supported and has less relative movement under occupant loads than the middle frame areas supported by the support arms 45 or even the upper frame corners 38 which have the greatest amount of displaceability. In this manner, the rear frame unit 55 provides for controlled flexing of the entire back frame 23.

Figure 14:
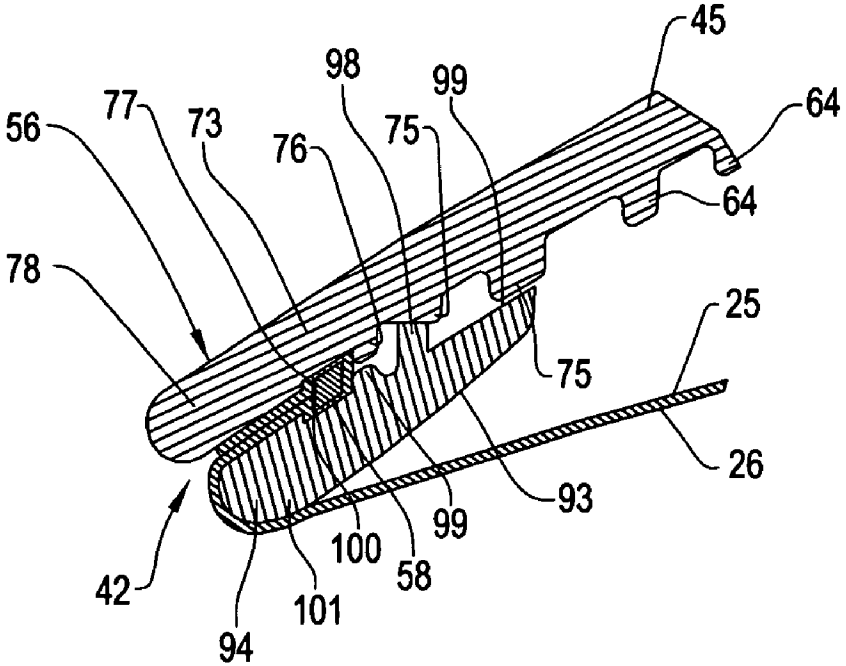
FIG. 14 is a top cross-sectional view of a side frame member as taken along line 14-14 of FIG. 6.

Referring to FIGS. 11 and 12, the rear frame ring 56 comprises top and bottom ring sections 71 and 72 and left and right ring sections 73 which extend vertically. As seen in FIG. 14, each side ring section 73 includes raised connector ribs 74 and 75 as well as an additional rib 76 which defines the inside end of the spline channel 42 and is also located directly adjacent to a spline groove 77 that is adapted to accommodate the thickness of the spline 58. The outer edge of the ring side section 73 includes a thinner portion 78 and essentially defines the rear side portion of the spline channel 42.

As to the horizontal rail section 71, this rail section 71 includes an interior rib 80, a channel rib 81 and an intermediate connector face 82. Adjacent to the channel rib 81, a spline groove 83 is provided to accommodate the thickness of the spline 58 while the outer edge portion 73 continues across the top ring section 71.

Figure 16:
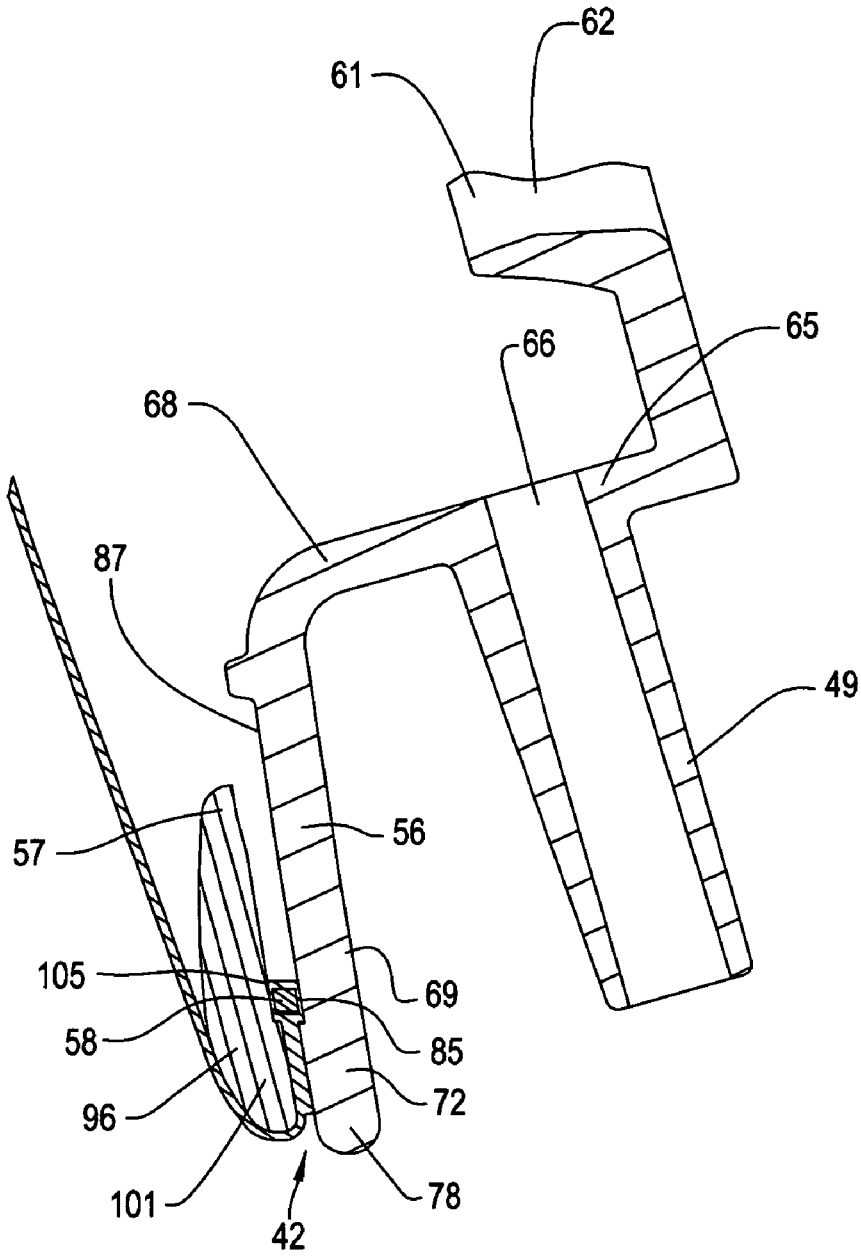
FIG. 16 is a side cross-sectional view of the bottom frame member as taken along line 16-16 of FIG. 6.

Referring to FIG. 16, the lower rail section 72 includes a spline channel 85 along its entire lateral width so as to accommodate the spline 58. Here again, the outer edge portion 78 continues through this region to define the back portion of the spline channel 42. In the middle of the lower ring section 72, a recessed pocket 87 is defined which opens upwardly and is located vertically adjacent to a locking post 88, the function of which will be described in further detail hereinafter.

The pocket 87 is defined by side walls 89 which side walls 89 include notches 90 at the bottom end thereof directly adjacent to the spline groove 85. It is noted that all of the spline grooves 77, 83 and 85 are arranged in end-to-end relation so as to define a continuous groove for continuously accommodating the spline 58 therein. Further, the channel ribs disposed directly adjacent to these spline grooves 77, 83 and 85 are formed continuously in end-to-end relation.

Turning next to the front frame ring 57, this frame ring 57 has a front face 92 which faces forwardly and a rear face 93 which faces rearwardly towards the rear frame ring 56 and is adapted to abut thereagainst and be fixedly secured thereto. This frame ring 57 is defined by vertical ring sections 94 and a top ring section 95 and a bottom ring section 96.

As to the side ring sections 94 (FIG. 14), these ring sections 94 include a rearwardly projecting connector rib 98 and an interior edge portion 99 which are adapted to abut against and be fixedly secured to the connector ribs 75 on the rear frame ring 56. Preferably, the front and rear frame rings 57 and 56 respectively are joined together by ultrasonic welding of these components with the faces disposed in contact being welded together. The front ring sections 94 are molded with a channel rib 99 disposed directly adjacent to a spline groove 100, which spline groove 100 is disposed in opposing relation with the other spline groove 77 to define an enlarged interior portion in which the spline 58 may be received. The outer edge portion 101 of the front ring 57 is disposed adjacent to but spaced apart from the other edge portion 78 to thereby define the entry portion of the spline channel 42.

Figure 15:
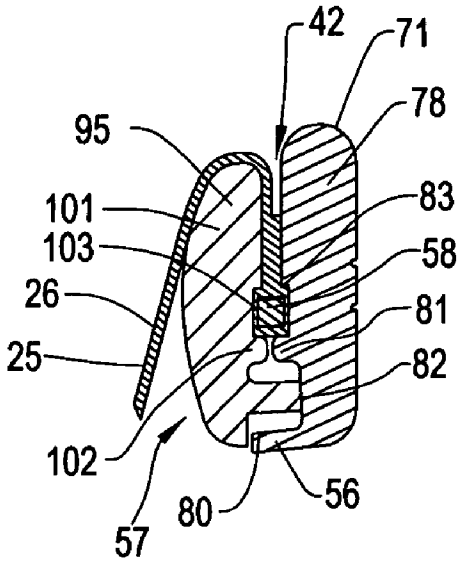
FIG. 15 is a side cross-sectional view of the top frame member as taken along line 15-15 of FIG. 6.

As to the top ring section 95 (FIG. 15), this is formed similar in that it includes a channel rib 102 and a spline groove 103 which is disposed directly adjacent to the outer edge portion 101 to thereby form the spline channel 42 in cooperation with the spline groove 83 and outer edge portion 78 of the rear frame ring 56. The outer edge portion 101 of the front frame ring 57 furthermore extends downwardly along the other vertical ring section 93 and then across the bottom ring section 96.

The bottom ring section 96 (FIG. 16) is formed with a spline groove 105 extending thereacross in alignment with the opposing rear spline groove 85. In this manner, the rear frame ring 56 defines a rear portion of the spline groove 42 while the front frame ring 57 defines a front portion thereof which said frame rings 56 and 57 when disposed in opposing relation define the channel 42 so that it opens radially outwardly and has an enlarged interior groove in which the spline 58 and associated fabric material may be received in non-removable engagement. As best seen in FIG. 14, the fabric 25 is wrapped around the spline 58 to essentially define a folded hem which folded hem is then pressed into the spline channel 42 by the tooling described herein relative to FIGS. 17-38.

In this manner, the suspension fabric 25 is tightly fitted onto the back frame 23 so that the fabric material 25 is stretched taut as generally illustrated in FIG. 10 and then angles away from the back frame 23 and spans the central frame opening 40.

Figure 13:
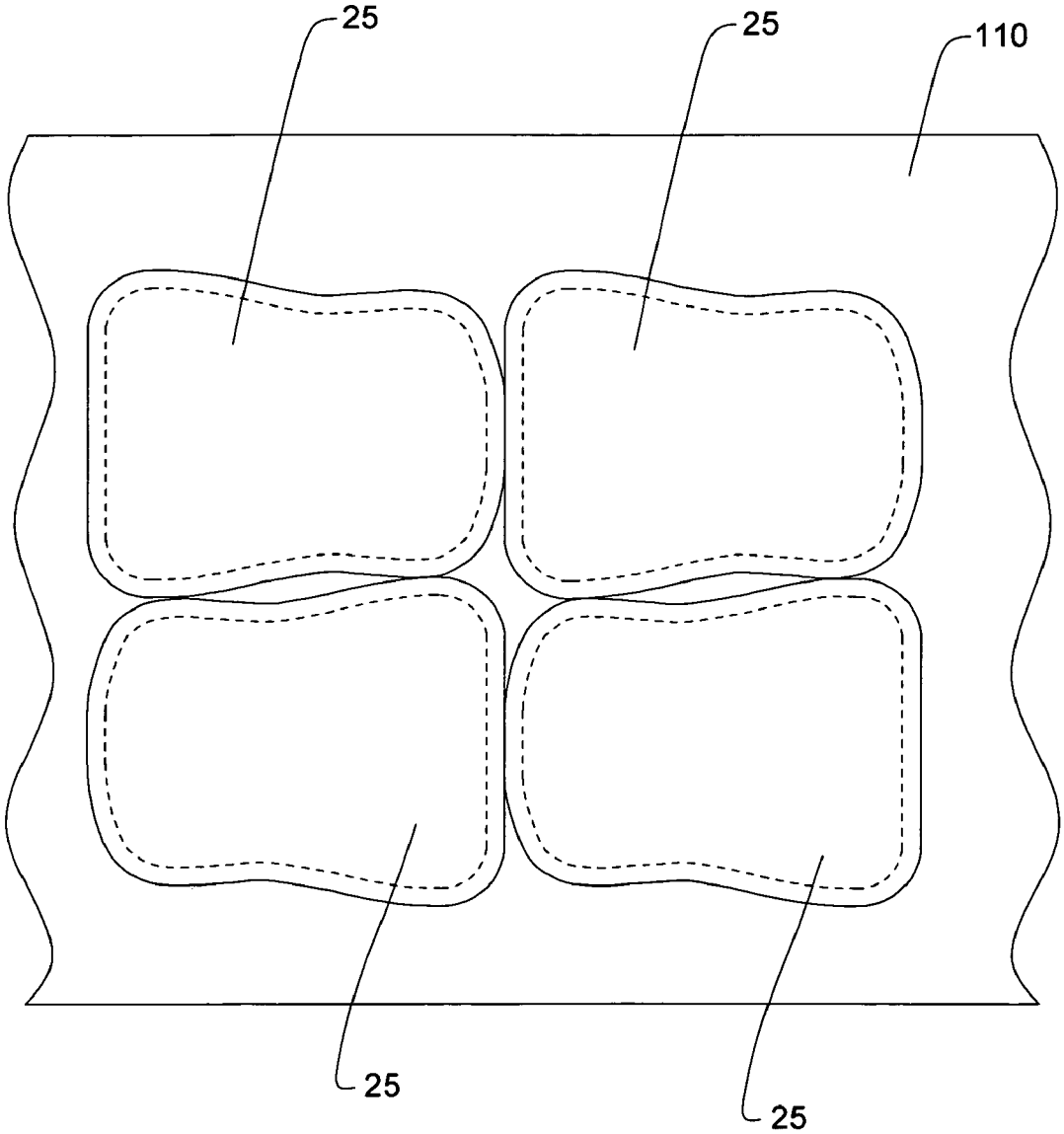
FIG. 13 is a diagrammatic view illustrating the manufacture of sheets of suspension fabric from a stock material.

The suspension fabric 25 is formed of any suitable suspension material which preferably is elastomeric and preferably has an open weave that provides for breathability. FIG. 13 generally illustrates the formation of the pieces of suspension fabric 25 wherein FIG. 13 illustrates an initial stock material 110 from which is cut multiple pieces of the suspension fabric 25. The suspension fabric 25 preferably is formed as a single layer but may have multiple overlying layers and may also include cushioning included therein.

Generally, the back frame 24 is assembled by first joining the rear frame ring 56 to the front frame ring 57 by ultrasonic welding. Thereafter, the suspension fabric 25 is resiliently stretched over the back frame 23 with the peripheral edges of the fabric 25 being affixed into the spline groove 42 by the spline 58.

Figure 17:
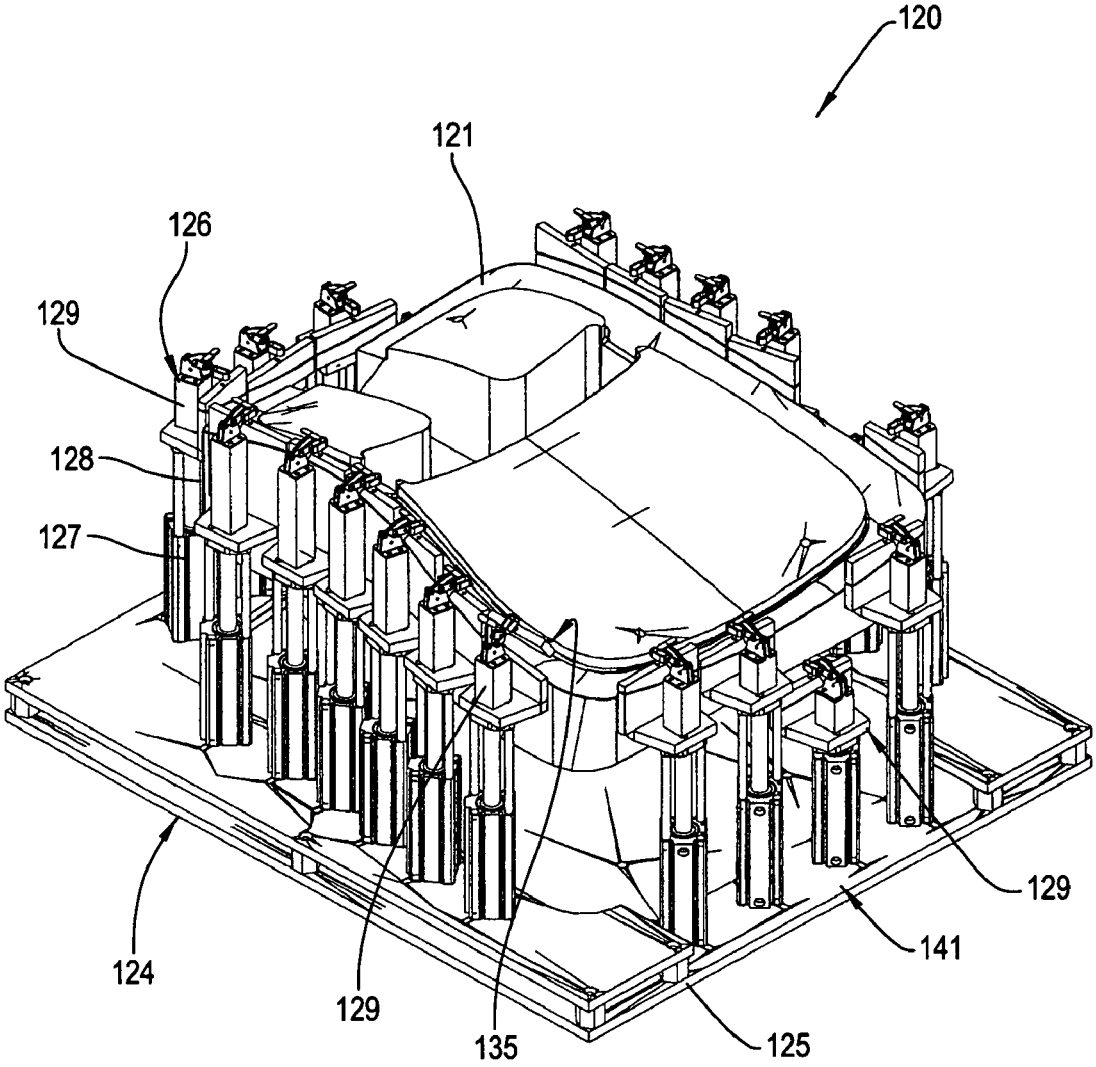
FIG. 17 is an isometric view of an attachment machine for securing the suspension fabric to the back frame.
Figure 20:
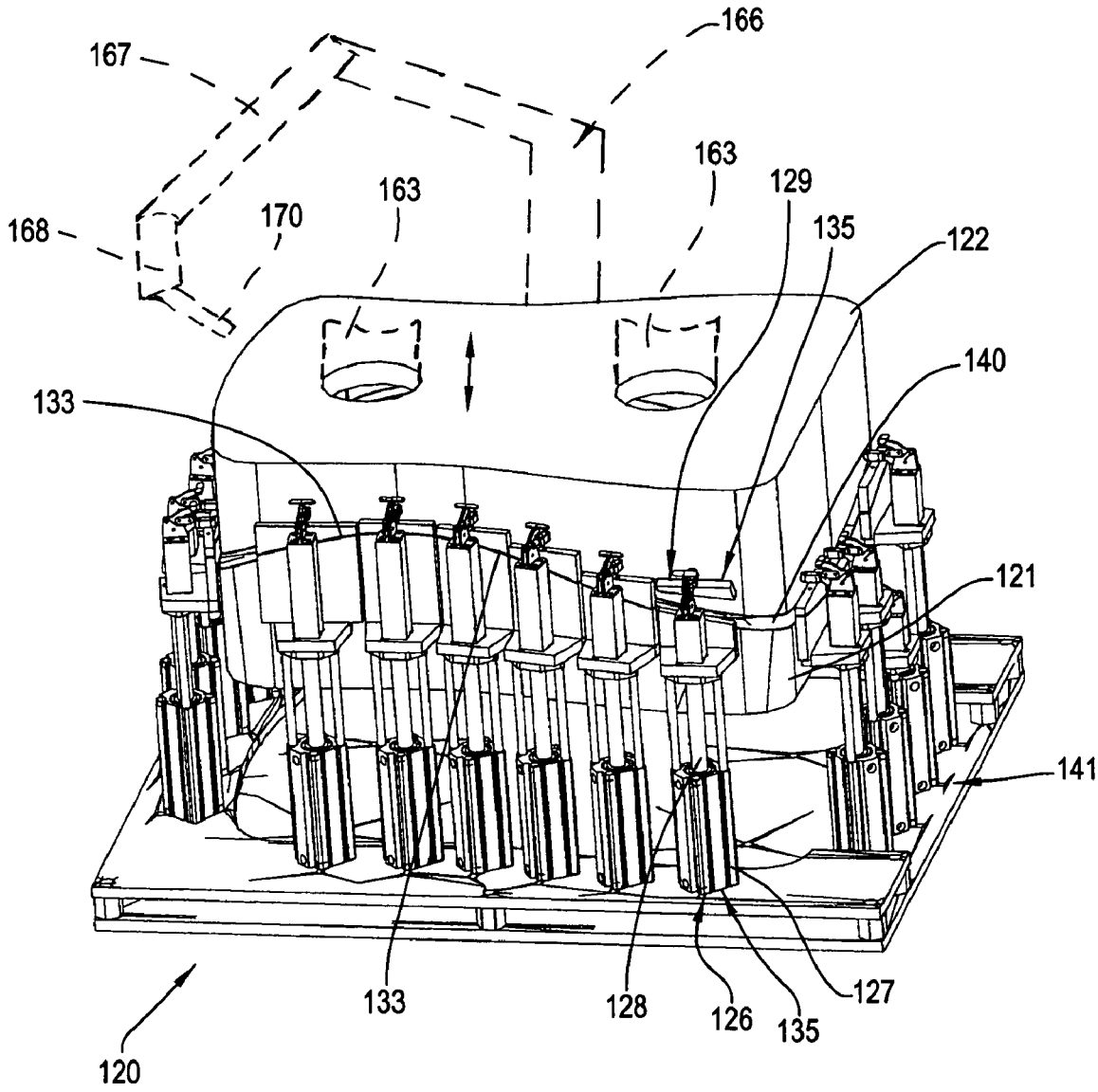
FIG. 20 is a front isometric view of the attachment machine with the top nest disposed in position.

Referring to FIGS. 17 and 20, an attachment machine 120 is illustrated for mounting the fabric 25 to the frame 23 by the spline 58. The attachment machine 120 comprises a lower nest 121 (FIG. 17) which is adapted to support the above-described frame 23 thereon, and further comprises a clamping body formed as an upper nest 122 (FIG. 20) which is adapted to press downwardly on the lower nest 121 and against the frame 23 therebetween.

Figure 18:
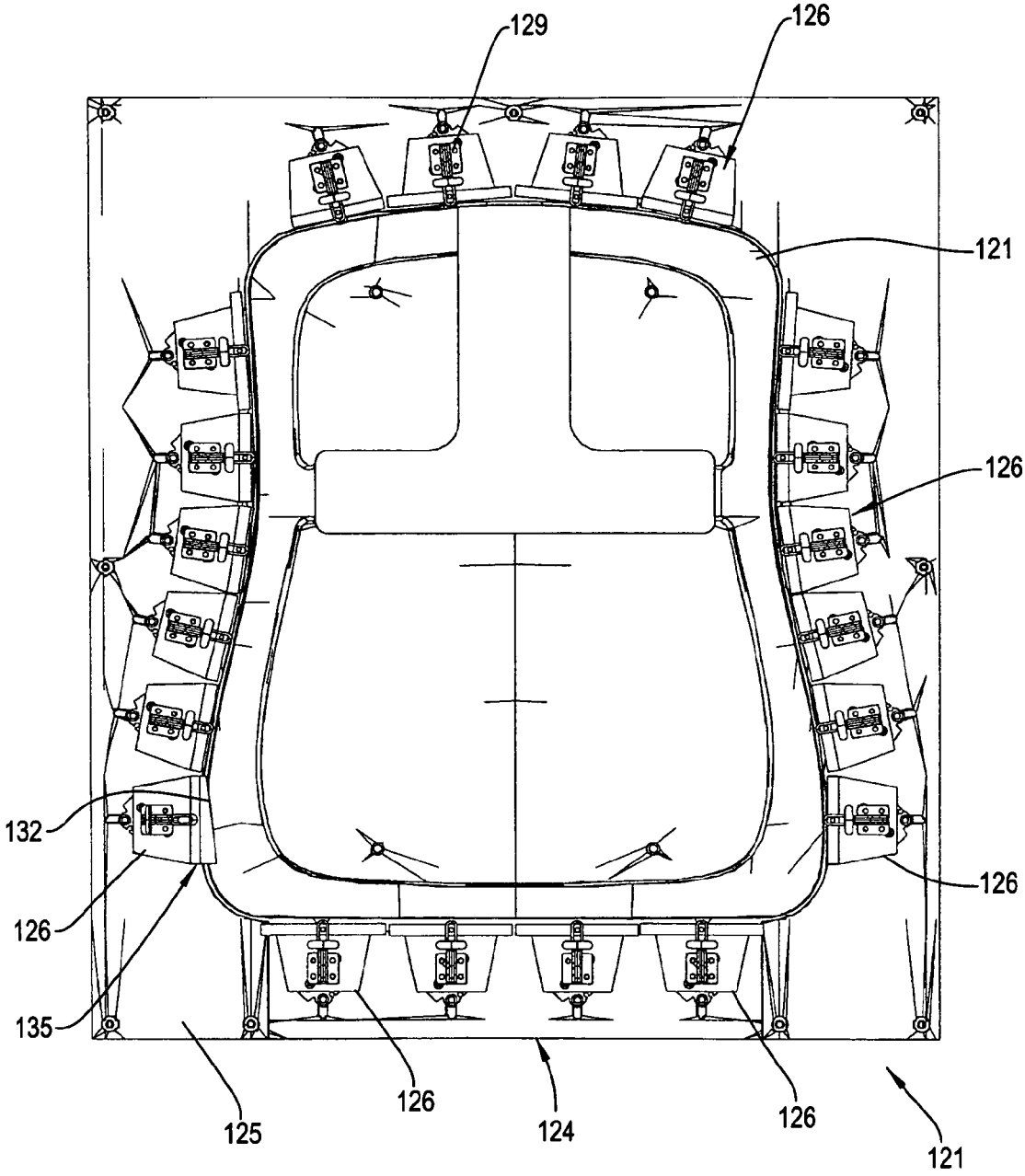
FIG. 18 is a plan view of the attachment machine illustrating a bottom nest in a use position with a top nest removed therefrom.
Figure 19:
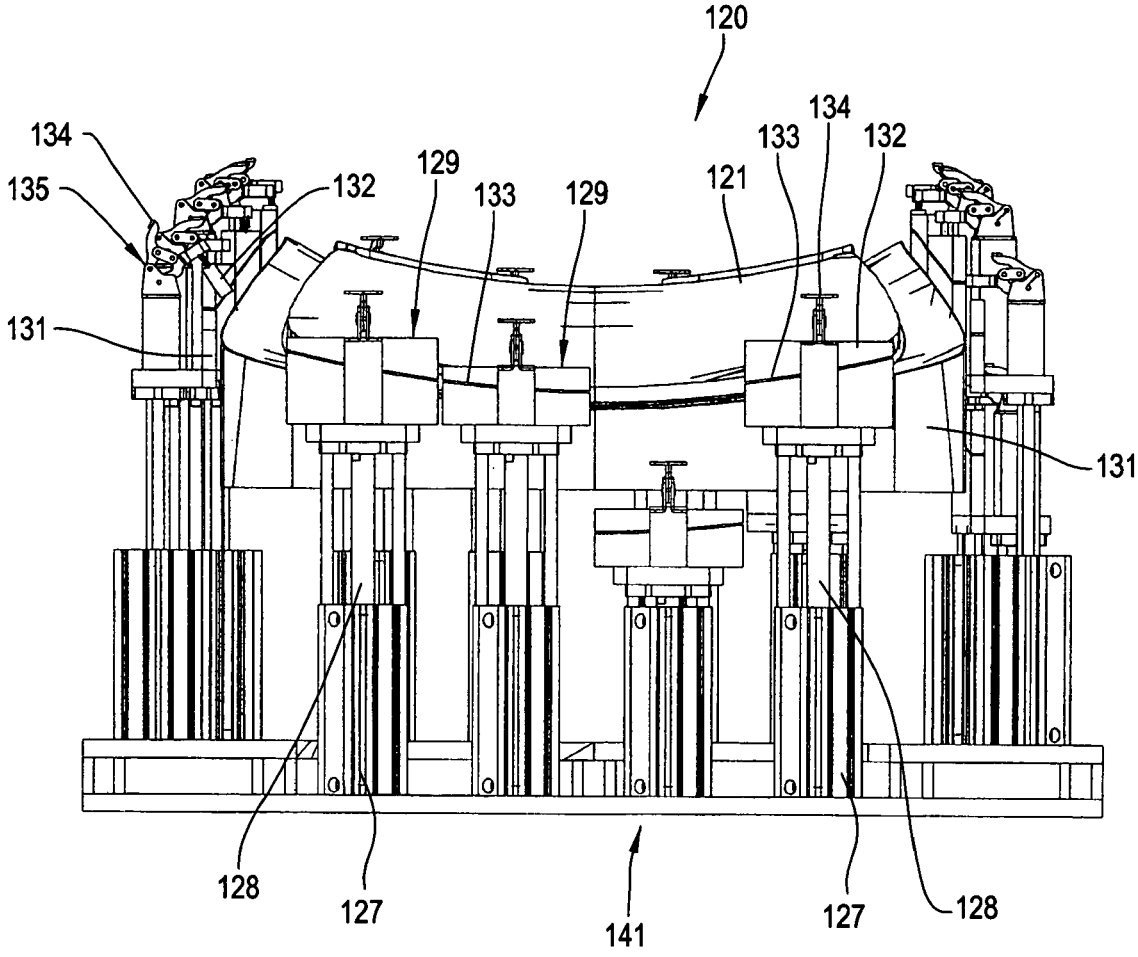
FIG. 19 is an end view of the attachment machine.

More particularly as to FIGS. 17-19, the attachment machine 120 includes a base assembly 124 having a base plate 125 on which the bottom nest 121 is supported. This base plate 125 supports a plurality of stretchers or clamp assemblies 126 thereon which clamp assemblies include a base column 127 that supports a pneumatic cylinder and includes an upstanding cylinder rod 128 thereon. On the upper end of the cylinder rod 128, a jaw assembly 129 is supported wherein actuation of the pneumatic cylinder 127 selectively raises and lowers the jaw assembly 129.

The lower nest 121 is disposed in the central region of the base plate 124 with a plurality of individual clamp assemblies 126 provided along each edge of the lower nest 121. In particular as seen in FIG. 18, six clamp assemblies 126 are provided along each opposite side edge of the lower nest 121 while four clamp assemblies 126 extend along each of the upper and lower end edges of the lower nest 121. The upper and lower end edges are identified relative to the upper and lower ends of the chair back 24 referenced above.

Referring to FIG. 19, each jaw assembly 129 generally is formed the same as each other and comprises a first lower fixed jaw 131 and a movable upper jaw 132 which define a clamping region or interface 133 therebetween. The upper jaw 132 is connected to a lever actuated cam mechanism 134 which allows the upper jaw 132 to be pivoted upwardly (such as at location 135 illustrated in FIGS. 17-9) and downwardly. It is noted that the contour of each jaw interface 133 of each of the various jaw assemblies 129 has a variable and preferably arcuate shape which conforms generally to the adjacent contour of the lower nest 121. Thus, when the jaw assemblies 129 are in the fully raised position generally illustrated in FIG. 20, the jaw interfaces 133 generally extend parallel to and directly align with the contour of the bottom nest 121. From the end as illustrated in FIG. 19, the jaw assemblies 129 at the opposite ends of the mechanism 120 curve downwardly in a generally concave shape. When viewed from the side as seen in FIG. 21, the jaw interfaces 133 generally extend or curve upwardly in a convex configuration.

Figure 21:
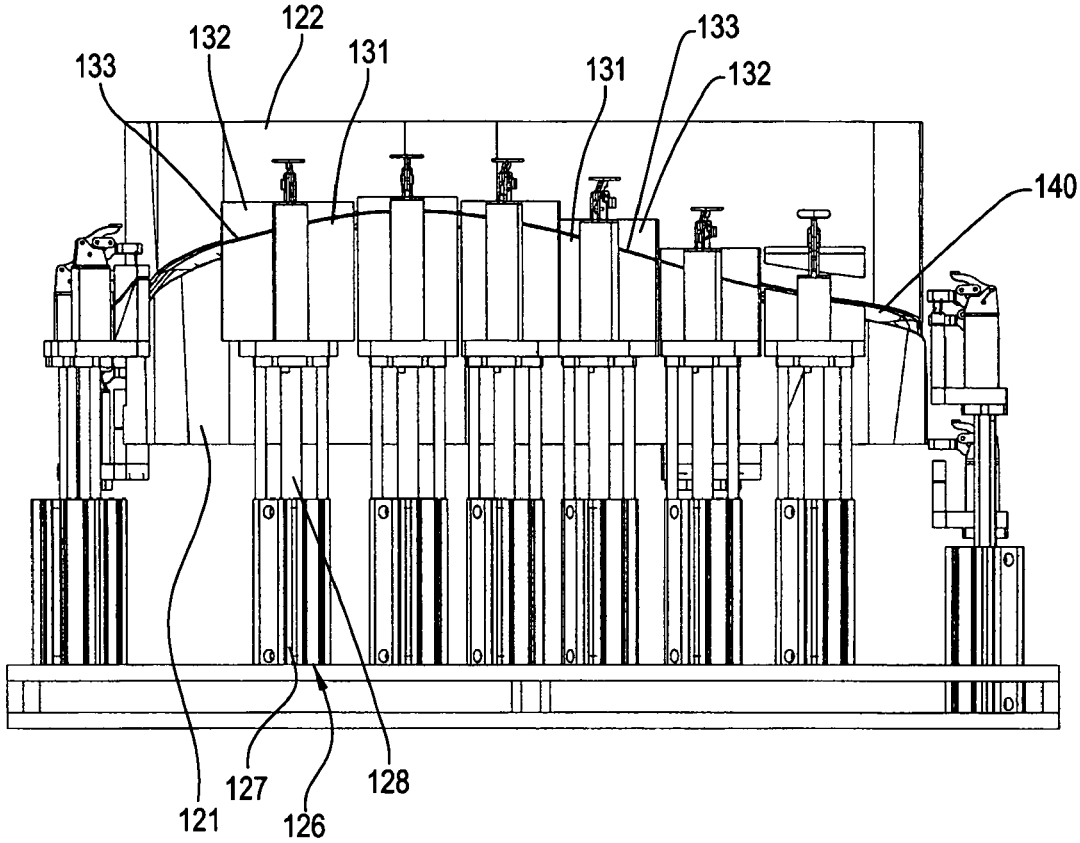
FIG. 21 is a side view of the attachment machine.
Figure 22:
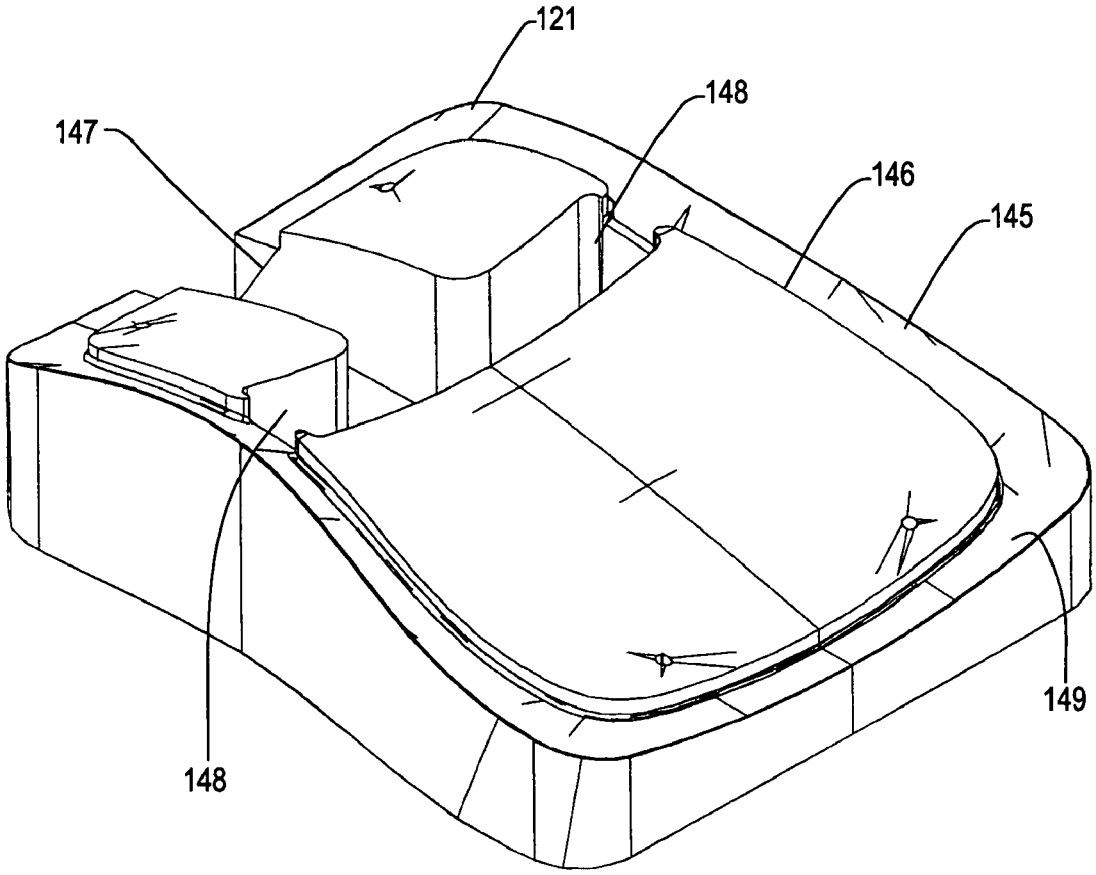
FIG. 22 is an isometric view of the bottom nest.

Referring to FIGS. 20 and 21, the upper nest 122 is adapted to be pressed downwardly onto the top of the bottom nest 121 wherein a frame receiving peripheral gap 140 is defined at the interface therebetween. This peripheral gap 140 is adapted to accommodate the thickness of the back frame 55 therein as generally depicted in FIGS. 34-38.

These jaw assemblies 129 therefore are normally positioned directly adjacent to the peripheral gap 140 when in the raised position illustrated in FIGS. 20 and 21. In this raised position, the jaw interfaces 133 are disposed directly adjacent to and at the same vertical elevation as the gap 140.

Since the jaw assemblies 129 are also drivingly interconnected to the cylinder shaft 128, the jaw assemblies 129 may be selectively lowered wherein the jaw assembly 129 at position 141 (FIG. 17) is illustrated in its lowermost limit of the down stroke thereof. Thus the jaw assemblies 129 may travel vertically from the lower stroke limit illustrated at position 141 (FIG. 17) to the uppermost position such as that illustrated at position 135 (FIG. 17) wherein the jaw assembly 129 may be opened by the cam actuator 134.

These jaw assemblies 129 therefore serve as peripheral stretcher clamps for stretching the suspension fabric 25 (FIGS. 35-38) lengthwise across the face of the fabric 25 as will be described in further detail herein. All of the stretcher clamps or jaw assemblies 129 are interconnected to a pneumatic control system which is configured so that these jaw assemblies 129 all move in unison downwardly during the stretching step of the method of the invention and the magnitude of the vertical stroke may be varied.

More particularly as to the bottom nest 121, this component is illustrated in FIGS. 22-25, wherein the lower nest 121 is formed out of a monolithic block of a suitable material such as plastic which will align and locate the frame 23 in position without marring the surface thereof.

The bottom nest is formed with a peripheral frame receiving space 145 which is shaped so as to have the same contour as the back frame 23. The interior edge 146 of this space 145 is disposed closely adjacent to the frame 23 and locates the frame 23 relative thereto. To accommodate the upright frame column 44 and the transverse support arms 45, the lower nest also includes a vertically elongate clearance pocket 147, which generally extends vertically, and includes transverse clearance pockets 148, wherein the pockets 147 and 148 respectively support the frame structures 44 and 45 therein so that the frame 23 seats uniformly. In this regard, the frame 23 has the back surface thereof disposed directly on the nest surface 149 to provide continuous support to the frame 23 about substantially its entire periphery.

Figure 23:
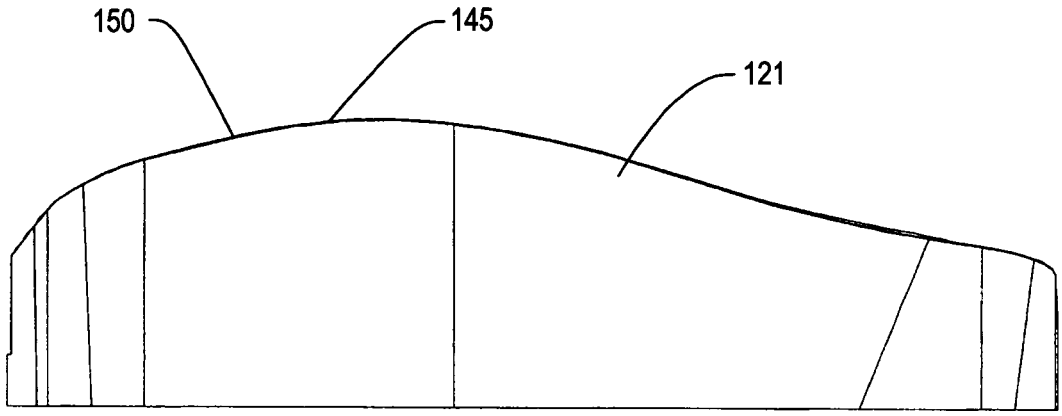
FIG. 23 is a side view of the bottom nest.

As seen in FIG. 23, the outer terminal edge 150 of the frame space 145 has a convex contour along most of its length with a slight concave contour approximate the upper end area thereof which is near the upper end of the frame 23. Next as seen in FIG. 24, the end region near the lower frame end has a concave contour and a relatively narrow lateral width.

Figure 24:
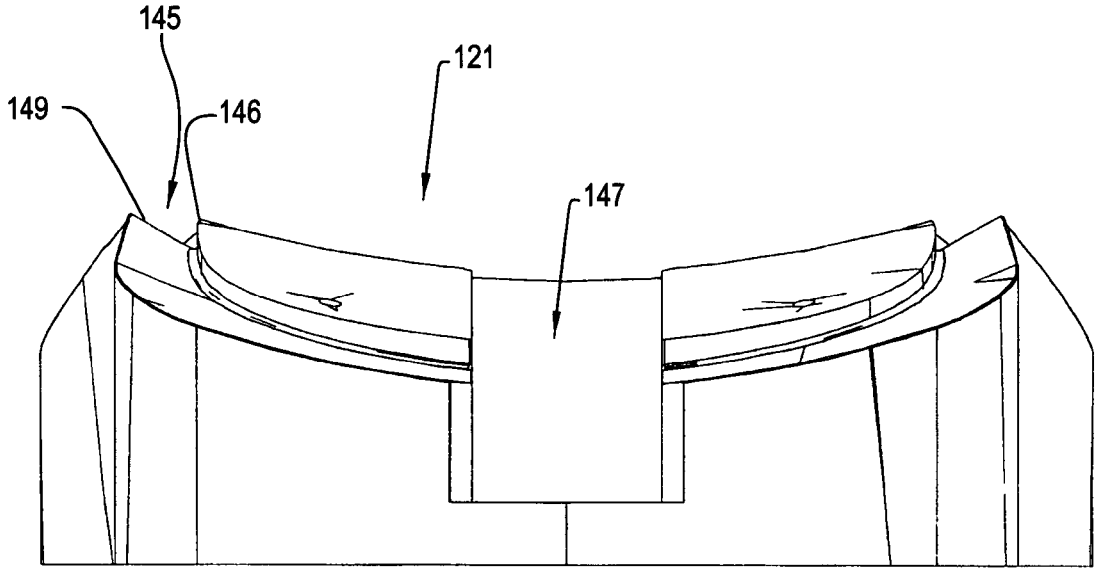
FIG. 24 is an end view of the bottom nest.
Figure 25:
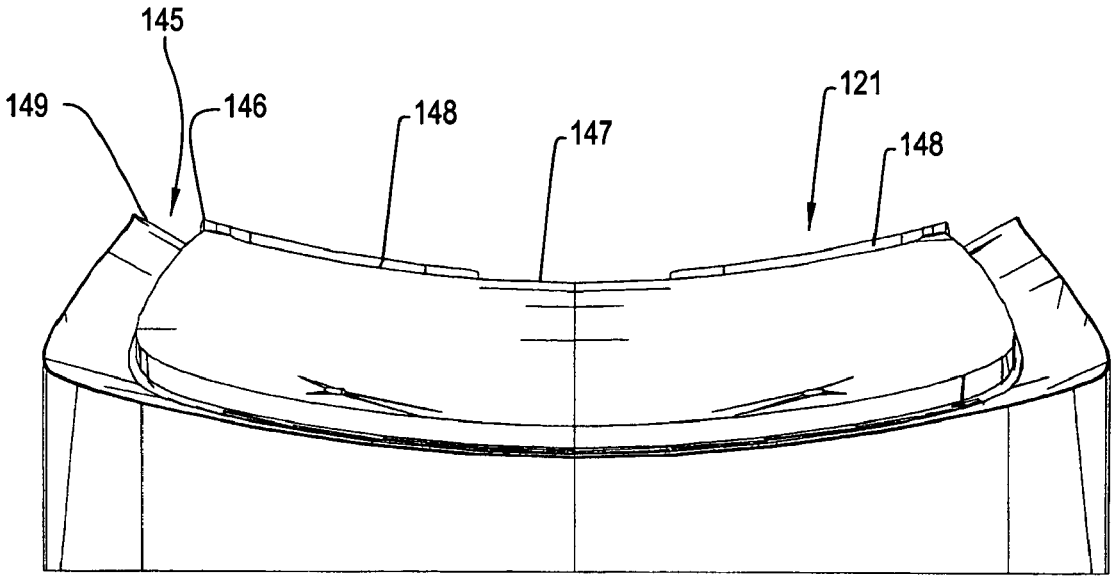
FIG. 25 is an end view thereof.
Figure 26:
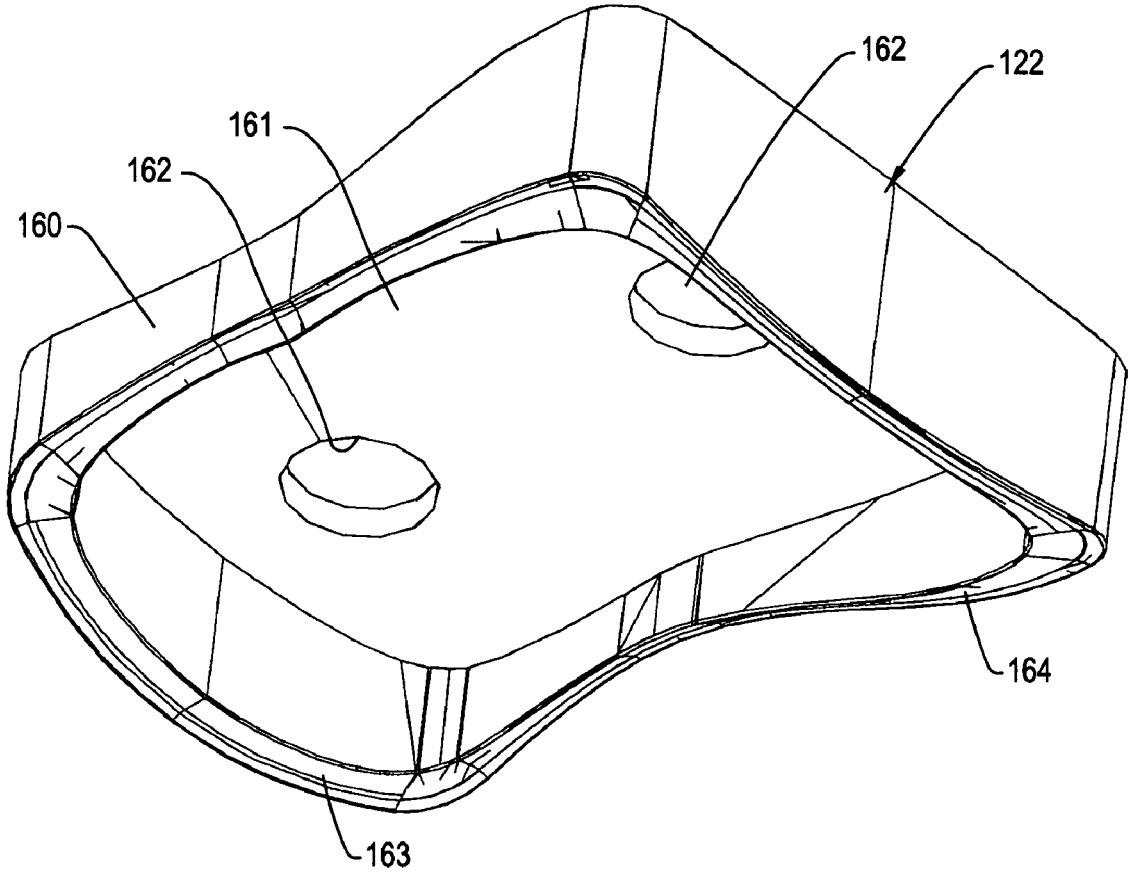
FIG. 26 is a bottom isometric view of the top nest.

Referring to FIG. 25, the end portion of the lower nest 121 near the upper frame end also has a concave contour but with a wider lateral width than the lower end portion illustrated in FIG. 24. As such, when the upper nest 122 is elevated, the lower nest 121 is exposed as in FIG. 17 and the frame 23 is fitted therein to the seated position illustrated in FIG. 34, preferably manually although it also would be possible to automate this process. In this position, the upper surface 152 (FIG. 34) of the frame 23 faces upwardly and is exposed.

Figure 27:
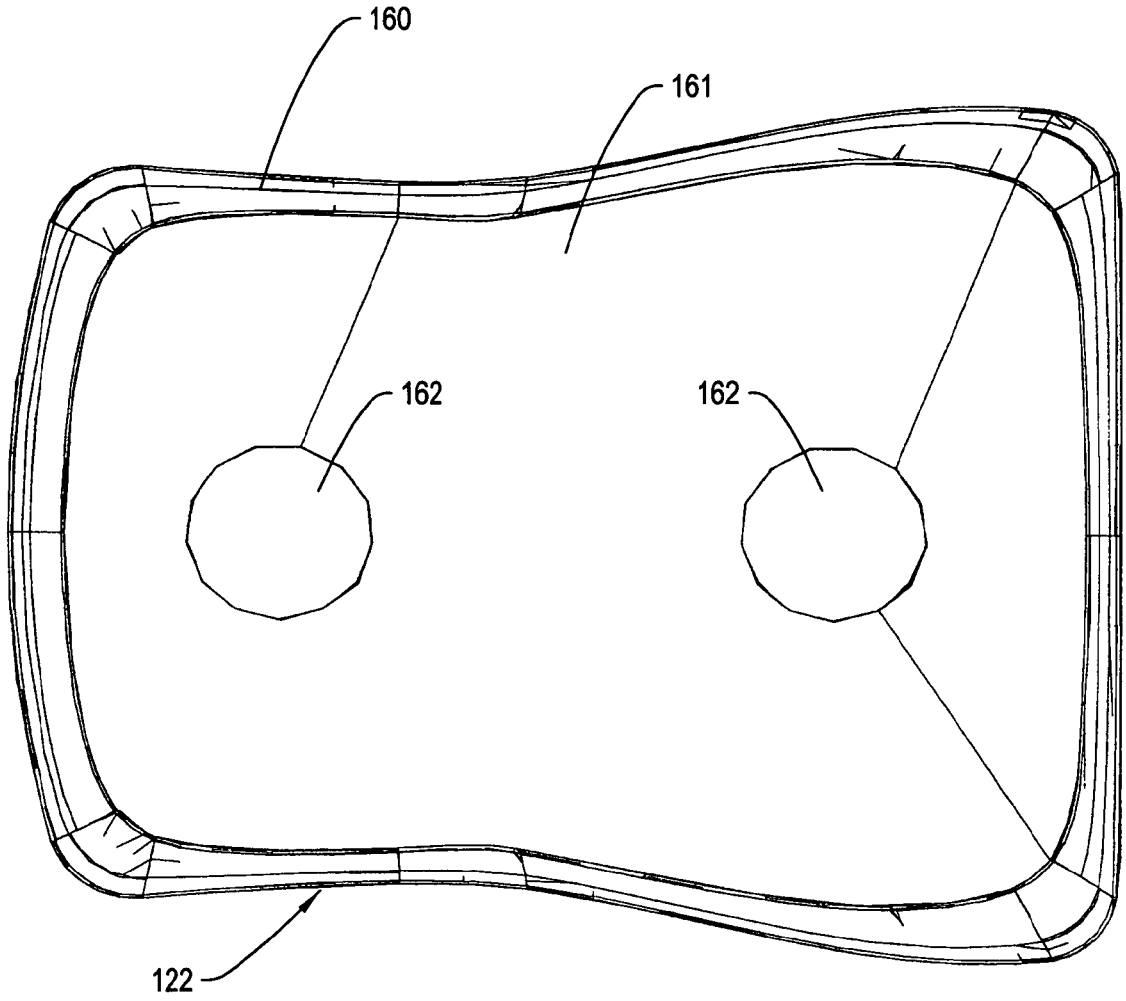
FIG. 27 is a bottom view of the top nest.

Referring to FIGS. 26-30, the upper nest 122 is defined by a peripheral wall 160 and an upper wall 161. The upper wall 60 includes a pair of attachment bores 162 therein which attach to a lift mechanism 163 (FIG. 20) which is adapted to automatically raise and lower the upper nest 122 by hydraulics to permit insertion and removal of the frame 55 from the frame space 145. When viewed from below as seen in FIG. 27, the upper nest 122 has the same geometric shape as the lower nest 121 illustrated in FIG. 18.

Figure 28:
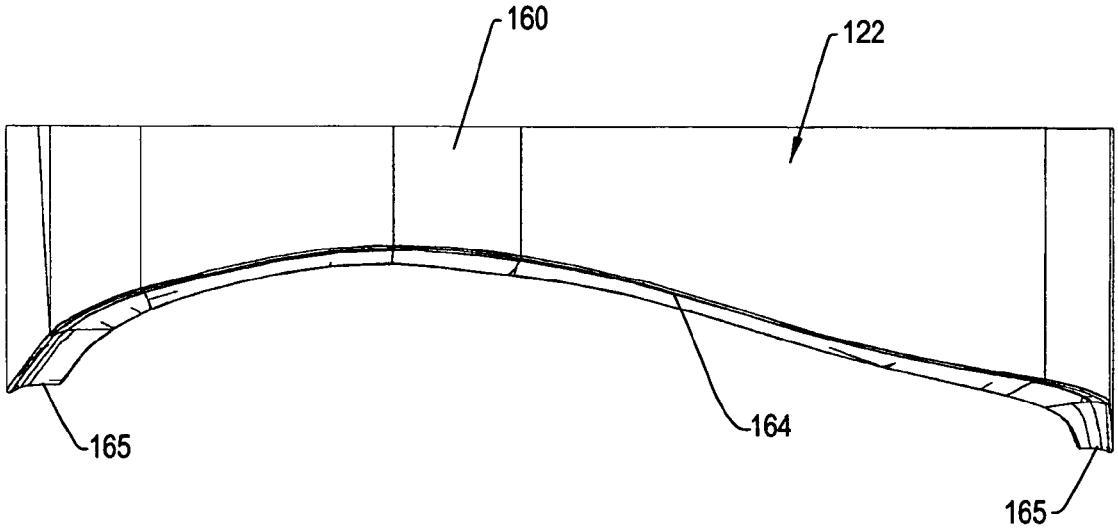
FIG. 28 is a side view thereof.
Figure 37:
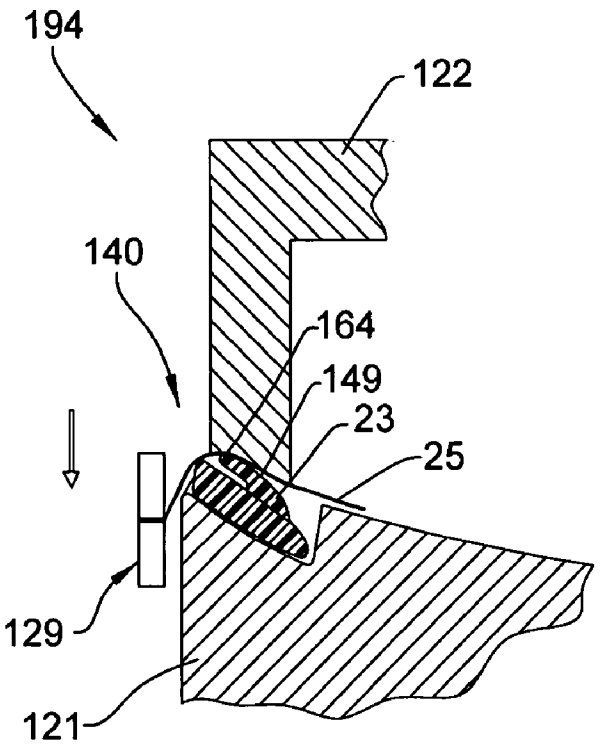
FIG. 37 illustrates the step of clamping the fabric to the frame.

The side wall 160 projects downwardly and the lower surface 163 thereof defines a downward facing clamping surface 164 which is adapted to press downwardly against the upper frame surface 149 as seen in FIG. 37. The thickness of the wall 160 is generally less than the width of the frame space 145 to provide clearance therebetween as the upper nest 122 is displaced downwardly during the attachment process. Referring to FIG. 28, the side contour of the clamping surface 164 generally conforms to the mirror image side contour of the lower nest 121 as seen in FIG. 23. Also, this clamping surface 164 has a generally arcuate shape as illustrated at location 165 which surface 165 at least partially conforms to the contoured frame face 149.

Figure 29:
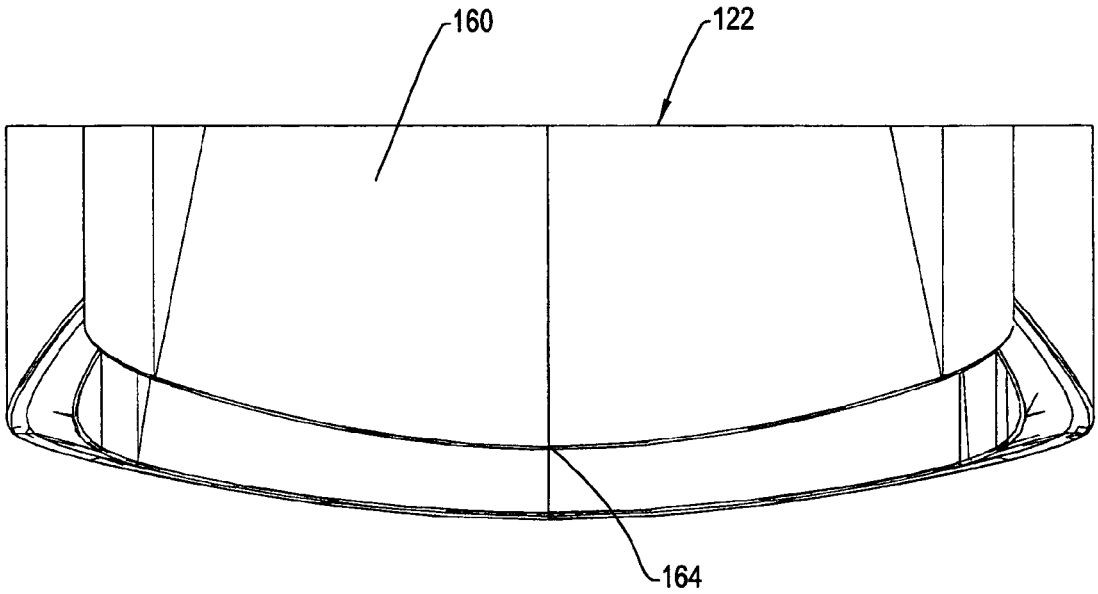
FIG. 29 is an end view thereof.
Figure 30:
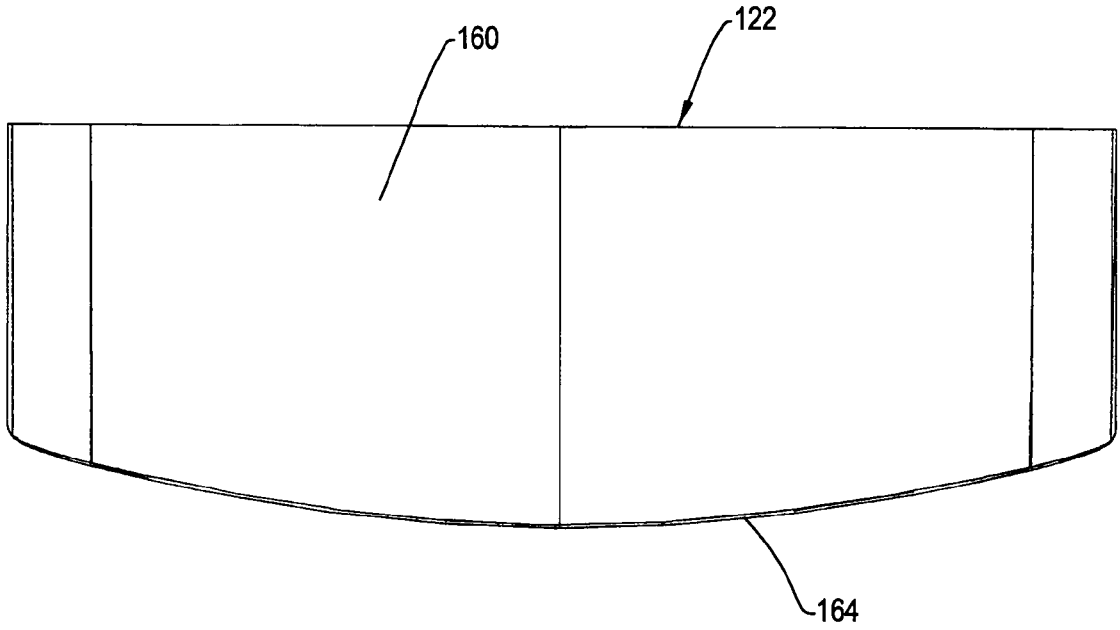
FIG. 30 is a further end view thereof.

Referring to FIG. 29, the clamping surface 164 at the narrow end portion has an arcuate contour which conforms to the opposing mirror image end contour of the lower nest 121 as illustrated in FIG. 24. Similarly as seen in FIG. 30, the wider end contour conforms to the respective end contour of the bottom nest 121 (FIG. 25). As such, the top nest 122 presses relatively evenly about the entire peripheral frame surface 149. This top nest 122 thereby serves as a clamp head which squeezes downwardly on the upper frame surface 49 to temporarily clamp and maintain the suspension fabric 25 thereon as will be described hereinafter.

The attachment machine 120 further includes a conventional robot unit 166 (FIG. 20) with a programmable articulating arm 167 that has a distal tool end 168 which is adapted to travel around the periphery of the frame 23 and in particular, travel around the frame space 140. This robot unit 168 is adapted to mechanically insert the spline 58 into the spline channel 42 during securement of the suspension fabric 25 onto the frame 23.

Figure 31:
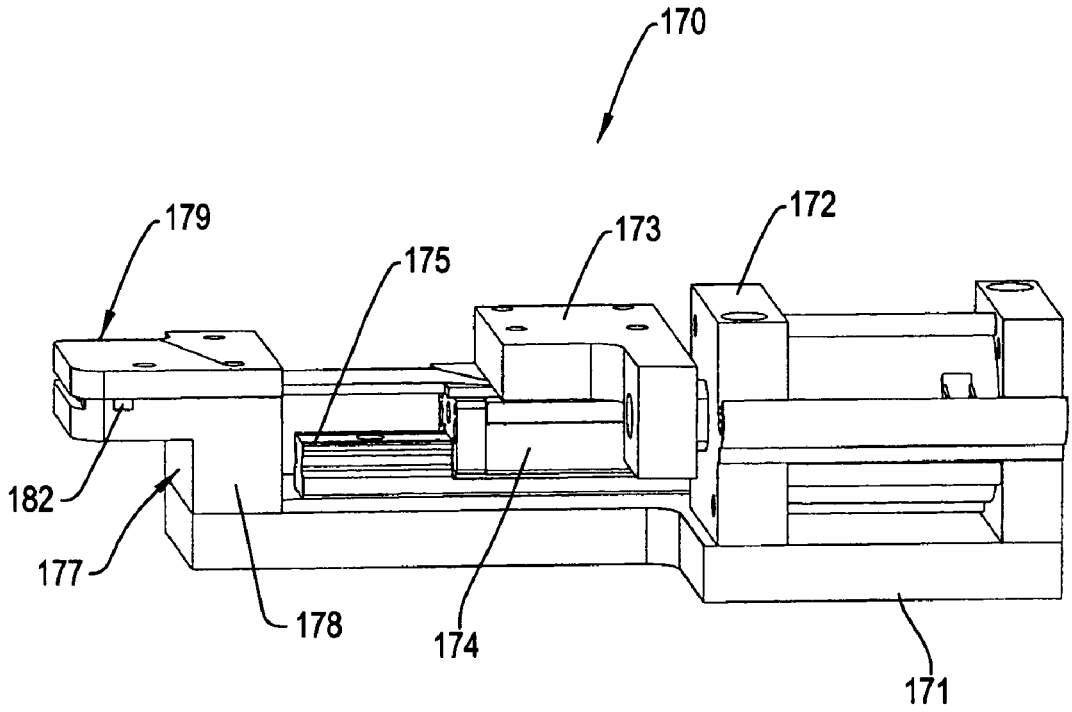
FIG. 31 is an isometric view of a robotic-driven spline tool.
Figure 32:
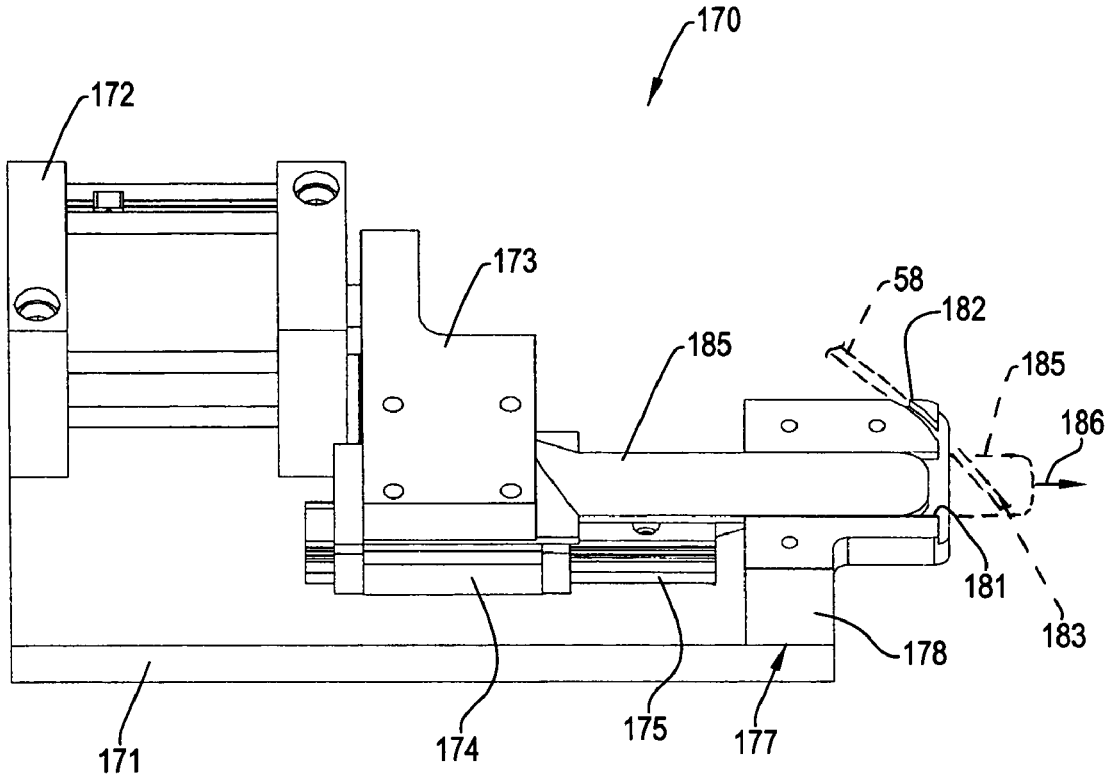
FIG. 32 is an isometric view of the spline tool with a guide cap removed therefrom and illustrating an elastomeric spline in phantom outline.
Figure 38:
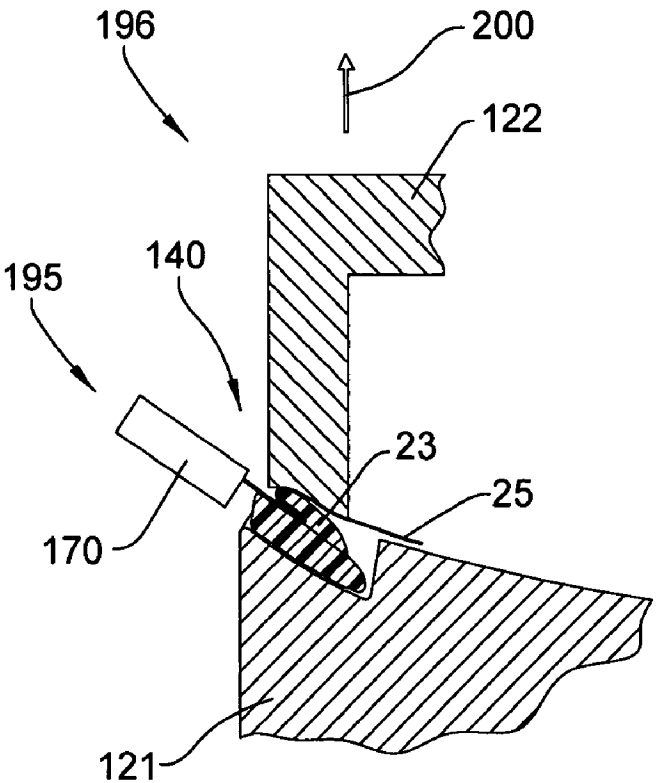
FIG. 38 illustrates the step of securing the fabric to the frame by the spline tool.

Referring to FIGS. 31 and 32, the robot unit 166 comprises a spline installation tool 170 on the movable distal end 168 thereof which is adapted to press the spline 58 into the spline groove 42 as diagrammatically depicted in FIG. 38. More particularly, the tool 170 (FIGS. 31-32) includes a base plate 171 wherein the tool 170 is rigidly affixed to the free end 168 of the robot arm 167 and is moved about the frame space 140 during installation of the spline 58. To effect insertion of the spline 58, the tool base plate 171 includes a linear drive unit 172 that is connected to a drive plate 173 to effect reciprocating linear movement of the drive plate 173. The drive plate 173 includes a slide block 174 that slidably engages a slide rail 175.

The outer end of the base plate 171 includes a guide housing 177 defined by a housing base 178 and a housing cover 179. As seen in FIG. 32 with the housing cover 179 removed, the housing base 178 includes an elongate guide channel 181 extending longitudinally therethrough as well as a spline guide 182 through which the free end of the spline 58 projects outwardly therefrom as seen in FIG. 32. This outer free end 183 of the spline 58 is the end which is fitted into the spline channel 42 when the frame is disposed within the machine 120.

Additionally, an installation blade 185 is mounted to the block 173 and projects horizontally through the guide channel 181. Therefore during linear movement of the slide block 174, the blade 185 is adapted to be either retracted as seen in FIG. 32 or extended as illustrated in phantom outline in FIG. 32. When the blade 185 is extended in the direction of arrow 186, this pushes the free end 183 of the spline 58 into the spline channel 42. The blade end 185 remains inside of the spline channel 42 during installation such that as the spline tool 170 is moved in parallel relation along the frame space 140, the blade 185 causes the spline 58 to be pressed between a fold of the suspension fabric 25 which is retained within the channel 42 as seen in the above-described FIGS. 14-16.

Figure 33:
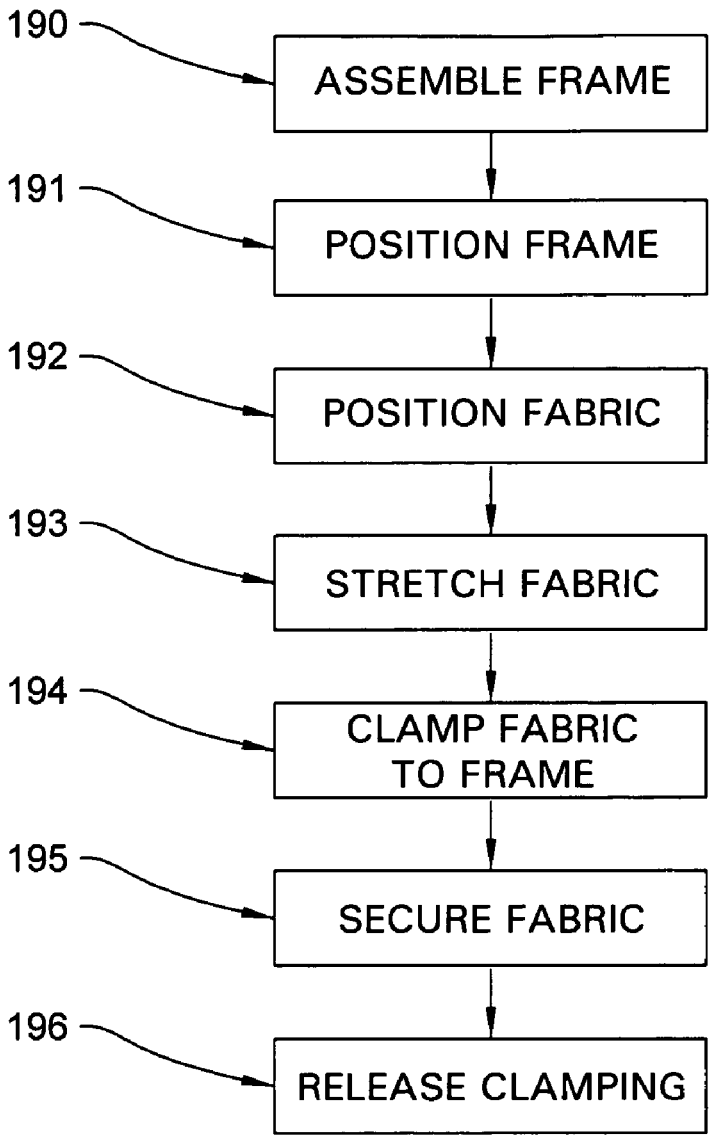
FIG. 33 is a flowchart of the attachment process.
Figure 34:
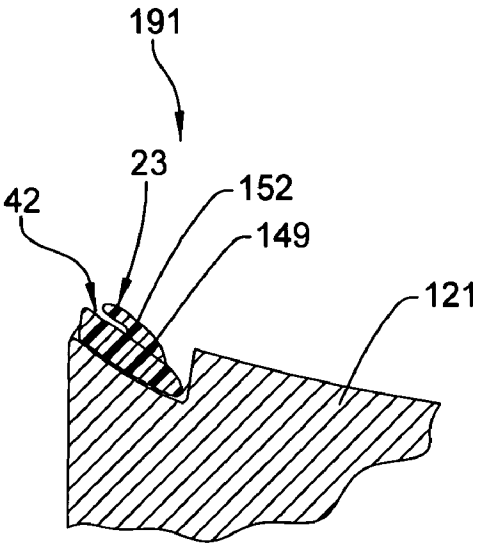
FIG. 34 illustrates the step of positioning the back frame in the bottom nest.

Referring more particularly to the process of the invention, FIG. 33 illustrates the various process steps in a preferred arrangement. First, the frame 23 is assembled together in step 190 by placing the front and back frame section 56 and 57 in opposing relation and then ultrasonically welding these two frame sections together as described above. Thereafter, in step 191, the frame is positioned into the bottom nest 121 as illustrated in FIG. 34. The frame unit 55 seats within the various grooves as described above with the frame surface 149 facing upwardly and the top nest 122 being elevated to a raised position by the lifting mechanism 163. This therefore exposes the upper surface of the bottom nest 121.

Figure 35:
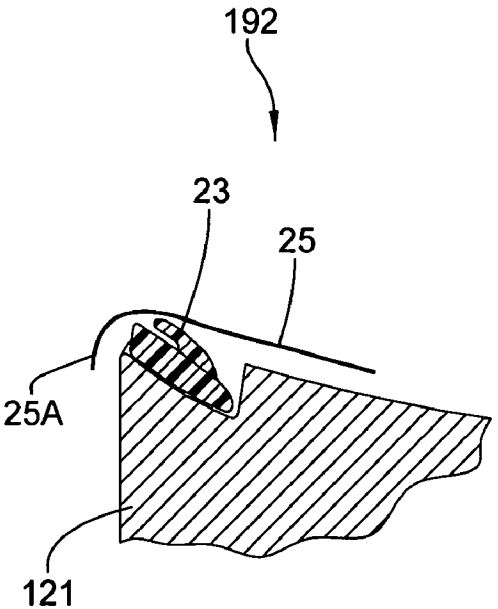
FIG. 35 illustrates the step of positioning a fabric thereon.

In step 192 the suspension fabric 25 is laid over the upper surface of the bottom nest 121 in a loose unstretched condition. The material blank for the suspension fabric 25 has a dimension which is slightly larger than the overall dimension of the frame unit 55 so that the outer peripheral edge 25A hangs outwardly from the outer peripheral edge of the frame 55 as seen in FIG. 35.

Thereafter, this peripheral edge 25A is slid into each of the various clamp assemblies 126 and the upper and lower jaws 132 and 131 of each jaw assembly 129 are pressed together by the respective cam mechanism 134. During this initial seating of the fabric edge 25A into the clamp assemblies 126, the jaw assemblies 129 are in the raised position illustrated in FIG. 19. To insert the fabric edge 25A in position, the cam actuator 134 is actuated to lift the upper jaw 132 as indicated in position 135 of FIG. 19. Thereafter, the lever 134 is articulated to lower the jaw 132 and clamp the fabric 25 therebetween in the interface 133. While the illustrated stretchers 129 are manually operated to grippingly engage the fabric edge 25A, this procedure also could be automated if desired.

Figure 36:
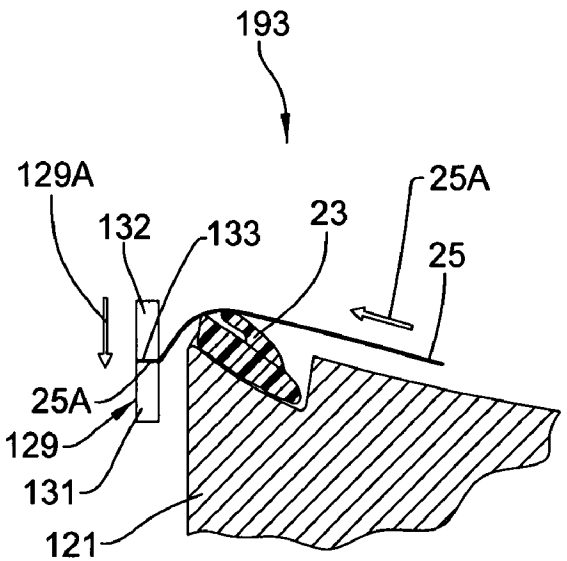
FIG. 36 illustrates the step of stretching the fabric.

In step 193, the fabric 25 is then stretched by displacing the jaw assemblies 129 downwardly as indicated by reference arrow 129A (FIG. 36) which thereby stretches the fabric 25 laterally and tensions same in the direction of reference arrow 129A (FIG. 36). The amount of downward displacement of the jaw assemblies 129 thereby governs the amount of tension in the fabric 25 and the individual jaw assemblies 129 may be displaced vertically downwardly in different amounts to vary the overall tension in different areas of the fabric 25. It is noted the jaw assemblies 129 are provided in aligned pairs to pull away from each other and tension the fabric therebetween.

Once the fabric 25 is stretched, the fabric 25 is clamped to the frame 55 in step 194 (FIGS. 33 and 37). In step 194, the top nest 122 is lowered downwardly until the nest surface 164 presses snuggly against the opposing frame face 149 which thereby clamps the fabric 25 downwardly therebetween in a direction transverse to the fabric face. This clamping force applied by the top nest 122 is sufficient to maintain the fabric 25 in a stretched condition. Thereafter, the jaw assemblies 129 are disengaged by separating the upper and lower jaws 132 and 133 and allowing the fabric edge 25A to hang loosely. Preferably, the jaw assemblies 129 are displaced downwardly to the lower position as seen in position 141 of FIG. 17 so as to provide an unobstructed space extending around the entire frame space 140.

In step 195 (FIGS. 33 and 38), the fabric edge 25A is then secured to the frame 55 by insertion or press fitting of the spline 58 into the spline groove 42 which thereby folds the fabric edge 25A about the spline 58 and secures the fabric 25 about its entire periphery to the frame 55. Once the fabric 25 is fully secured in position, the clamping force provided by top nest 122 is released. Therefore, the next step is step 196 (FIGS. 33 and 38) wherein the top nest 122 is raised upwardly in the direction of reference arrow 200. This thereby discontinues the clamping action of the top nest 122 and since the edge 25A of the suspension fabric 25 is secured to the frame 55, the fabric 25 remains in its stretched condition and the entire back frame assembly 24 is assembled.

With this arrangement, selective stretching may be provided to the fabric 25 depending upon the different amounts of vertical travel or stroke of the various jaw assemblies 129 while still using a spline type connection between the fabric 25 and the frame 55.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A method for mounting a suspension fabric to a frame of a chair comprising the steps of:

providing a chair frame having a peripheral frame section which defines an open interior region and a peripheral groove extending about said peripheral frame section;

providing a suspension fabric which is resiliently stretchable between an unstretched condition and a stretched condition, said suspension fabric having a peripheral edge portion;

engaging and stretching said suspension fabric to said stretched condition having a size greater than the size of the suspension fabric in said unstretched condition;

positioning said stretched suspension fabric over a face of said frame with an interior portion overlying said open interior region;

clamping said stretched suspension fabric against said frame face by a clamping body disposed in opposing relation with said frame face which presses said suspension fabric against said frame face with said suspension fabric being clamped between said frame face and said opposing clamping body, said clamping body being movable toward and away from said face of said frame;

releasing said engagement of said peripheral edge of said suspension fabric when clamped against said frame such that said peripheral edge portion returns to an unstretched condition and said interior portion of said suspension fabric remains in said stretched condition;

securing said peripheral edge portion to said frame by insertion of a spline member into said peripheral groove which fixes said peripheral edge to said frame; and removing said clamping body with said suspension fabric being maintained in said stretched condition by said securing of said peripheral edge to said peripheral groove by said spline member.

2. The method according to claim 1, wherein said suspension fabric is stretched from said unstretched condition to said stretched condition by clamp devices which engage said peripheral edge and stretch said suspension fabric lengthwise.

3. The method according to claim 2, wherein said step of releasing said peripheral edge portion includes the step of disengaging said clamp devices from said peripheral edge portion.

4. The method according to claim 1, wherein said clamping body includes a clamping surface extending about the periphery of said clamping body which said clamp surface conforms to said frame face and presses said stretched suspension fabric against said frame face.

5. The method according to claim 4, wherein said peripheral edge portion is engaged by clamp assemblies which have gripping jaws wherein said stretching of said suspension fabric includes the steps of gripping said peripheral edge with said clamp assemblies and displacing said clamp assemblies to stretch said suspension fabric to said stretched condition.

6. The method according to claim 1, further including the steps of positioning said suspension fabric in said unstretched condition over the frame face, gripping the peripheral edge thereof with clamp assemblies, and displacing said clamp assemblies to stretch said suspension fabric to said stretched condition.

7. An assembly apparatus for mounting a suspension fabric to a chair frame wherein said chair frame has a peripheral frame section which defines a frame opening and said suspension fabric is resiliently stretchable to a stretched condition so as to span said frame opening and has a peripheral edge portion which is engaged with said frame such that said suspension fabric is secured to said frame in said stretched condition, the apparatus comprising:

a support unit for supporting said frame with a frame face facing outwardly therefrom, said suspension fabric initially being provided over said frame in an unstretched condition with a peripheral edge portion of said suspension fabric extending outwardly beyond the outer periphery of said frame;

a stretching arrangement which engages said peripheral edge portion and effects stretching of said suspension fabric to said stretched condition wherein said suspension fabric overlies said frame face and extends beyond said frame periphery;

a clamp body which is displaceable downwardly toward said frame face and includes an opposed clamping surface which presses against said stretched suspension fabric so as to clamp said suspension fabric against said frame face in said stretched condition;

said stretching arrangement being releasable when said suspension fabric is clamped to said frame face to permit said peripheral edge portion of said suspension fabric to hang loose while said suspension fabric is maintained in said stretched condition by said clamp body; and a securing arrangement which fixedly secures said loose peripheral edge portion of said suspension fabric to said frame, said clamp body being displaceable away from said frame face after said peripheral edge portion of said suspension fabric is secured to said frame so as to maintain said suspension fabric in said stretched condition after said clamp body is displaced away therefrom.

8. The apparatus according to claim 7, wherein said stretching arrangement comprises a plurality of clamp assemblies positioned about the frame periphery which are engagable with said peripheral edge of said suspension fabric.

9. The apparatus according to claim 8, wherein said clamp assemblies and said support unit are displaceable one relative to the other to effect stretching of said suspension fabric.

10. The apparatus according to claim 9, wherein said clamp assemblies include displaceable jaws which are movable toward each other to clamp the fabric edge portion therebetween.

11. The apparatus according to claim 10, wherein said clamp assemblies are movable to effect said stretching of said suspension fabric.

12. The apparatus according to claim 7, wherein said peripheral clamping surface is contoured so as to at least partially conform to a contour of the frame face.

13. The apparatus according to claim 7, wherein said frame includes a peripheral groove in which a spline member is frictionally fitted.

14. The apparatus according to claim 7, wherein said securing arrangement comprises a spline tool and an elongate spline wherein such spline tool is displaceable about an outer periphery of said frame to insert said spline and said peripheral edge portion of said suspension fabric into a corresponding groove formed in said frame for fixed securement of the suspension fabric to said frame.

15. A method for mounting a suspension fabric to a furniture frame comprising the steps of:

providing a furniture frame formed in a loop so as to define a frame opening, said furniture frame having securing structure extending about a periphery of said frame opening;

providing a suspension fabric adapted to be positioned over said furniture frame to span said frame opening, said suspension fabric being resiliently stretchable between an unstretched condition and a stretched condition, the suspension fabric having a peripheral edge portion;

engaging said peripheral edge portion and stretching said suspension fabric to said stretched condition wherein said suspension fabric when in said stretched condition is positioned closely adjacent to a face of said furniture frame;

clamping said stretched suspension fabric against said frame face by a clamping body disposed in opposing relation with said frame face wherein said suspension fabric is clamped between said frame face and said clamping body, said peripheral edge portion being disposed outwardly of said clamping body, said clamping body being moveable towards said frame face for said clamping of said suspension fabric;

releasing said engagement of said peripheral edge portion of said suspension fabric while said suspension fabric is clamped against said furniture frame by said clamping body, after which said peripheral edge portion is exposed outwardly of said clamping body;

securing said exposed peripheral edge portion to said frame by securement structure which engages with said securing structure on said furniture frame; and removing said clamping body by said clamping body away from said frame face wherein said suspension fabric remains in said stretched condition on said furniture frame by said securement structure.

16. The method according to claim 15, wherein clamp devices are provided which engage said peripheral edge portion of said suspension fabric to effect stretching thereof to said stretched condition.

17. The method according to claim 15, wherein said method further includes the steps of gripping said peripheral edge portion of said suspension fabric with clamp assemblies and displacing said clamp assemblies to stretch said suspension fabric to said stretched condition.

18. The method according to claim 17, wherein said securement structure comprises an elongate spline member and said securing structure comprises a corresponding edge groove in said furniture frame, said method further including the step of inserting said spline member into said edge groove for said securing of said stretched suspension fabric to said furniture frame.

19. A method for mounting a suspension fabric to a furniture frame comprising the steps of:

providing a furniture frame having a frame face and a peripheral frame edge portion;

positioning said furniture frame in a support unit with said frame face facing upwardly;

providing a stretchable fabric adapted to be positioned over said furniture frame to span said furniture frame in a region between said frame edge portion, said fabric being resiliently stretchable between an unstretched condition and a stretched condition, the fabric having a peripheral fabric edge portion;

engaging said fabric edge portion and stretching said fabric to said stretched condition wherein said fabric when in said stretched condition is positioned closely adjacent to and vertically above said frame face of said furniture frame;

clamping said stretched fabric against said frame face by a clamping body which has a clamping face that faces toward said frame face in opposing relation therewith, wherein said stretchable fabric is clamped between said frame face and said clamping face by moving said clamping body downwardly toward said frame face, said fabric edge portion being disposed outwardly of said clamping body when said fabric is clamped;

releasing said engagement of said fabric edge portion while said fabric is clamped against said furniture frame by said clamping body, after which said fabric edge portion is exposed outwardly of said clamping body;

securely attaching said exposed fabric edge portion to said frame edge portion when said fabric is clamped in said stretched condition; and removing said clamping body by moving said clamping body away from said furniture frame and said fabric attached thereto wherein said fabric remains in said stretched condition on said furniture frame.

20. The method according to claim 19, further including the steps of providing securement structure which comprises an elongate spline member and a corresponding edge groove in said furniture frame and seating of said spline member into said edge groove for said attaching of said stretched fabric to said furniture frame when clamped thereon.

21. The method according to claim 19, wherein clamp devices are provided which engage said fabric edge portion to effect stretching thereof to said stretched condition.

22. The method according to claim 21, wherein said step of releasing said fabric edge portion includes the step of disengaging said clamp devices from said fabric edge portion.

23. The method according to claim 22, wherein said clamping face conforms to said frame face and presses said stretched fabric against said frame face.

24. The method according to claim 19, wherein said support unit supports said furniture frame with said frame face facing outwardly therefrom, said suspension fabric initially being provided vertically above said frame face in an unstretched condition with a peripheral edge portion of said suspension fabric extending outwardly beyond an outer periphery of said furniture frame.

* * * * *